US007344238B2

(12) United States Patent
Tanaka et al.

(10) Patent No.: US 7,344,238 B2
(45) Date of Patent: Mar. 18, 2008

(54) INKJET RECORDING DEVICE

(75) Inventors: Kuniaki Tanaka, Ebina (JP); Hiroshi Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 278 days.

(21) Appl. No.: 11/130,862

(22) Filed: May 17, 2005

(65) Prior Publication Data

US 2006/0050126 A1 Mar. 9, 2006

(30) Foreign Application Priority Data

Sep. 7, 2004 (JP) ..... 2004-259853
Jan. 28, 2005 (JP) ..... 2005-021621

(51) Int. Cl.
*B41J 2/01* (2006.01)
*B41J 3/60* (2006.01)
*B41J 13/08* (2006.01)

(52) U.S. Cl. ..... 347/104; 400/629; 400/188

(58) Field of Classification Search ..... None
See application file for complete search history.

(56) References Cited

U.S. PATENT DOCUMENTS 5,447,303 A * 9/1995 Smith ..... 271/291
6,626,103 B2 * 9/2003 Neumann ..... 101/230
2004/0036738 A1 * 2/2004 Lorenz et al. ..... 347/37

FOREIGN PATENT DOCUMENTS

| | | | |
|---|---|---|---|
| GB | 2 128 139 | | 4/1984 |
| JP | 60036258 A | * | 2/1985 |
| JP | 7-149009 | | 6/1995 |
| JP | 8-337011 | | 12/1996 |
| JP | 9-327950 | | 12/1997 |
| JP | 2000-1010 | | 1/2000 |
| JP | 2001122480 A | * | 5/2001 |
| JP | 2003-154643 | | 5/2003 |
| JP | 2003-205657 | | 7/2003 |
| JP | 2004043111 A | * | 2/2004 |

* cited by examiner

*Primary Examiner*—Daniel J. Colilla
(74) *Attorney, Agent, or Firm*—Fildes & Outland, P.C.

(57) ABSTRACT

The present invention provides an inkjet recording device for forming an image on a recording medium with an inkjet recording head. The inkjet recording device is provided with a conveyance section and a switchback section. One face of the recording medium is adhered to the conveyance section and the conveyance section transports the recording medium to the inkjet recording head. An image is formed on the other face of the recording medium, and the recording medium is transferred to the switchback section from the conveyance section, with the one face of the recording medium being adhered to the switchback section. The switchback section feeds the recording medium back to the conveyance section such that the other face of the recording medium can be adhered to the conveyance section.

16 Claims, 17 Drawing Sheets

INKJET RECORDING DEVICE

CROSS-REFERENCE TO RELATED APPLICATION

This application claims priority under 35 USC 119 from Japanese Patent Applications No. 2004-259853 and No. 2005-021621, the disclosures of which are incorporated by reference herein.

BACKGROUND OF THE INVENTION

1. Field of the Invention

The present invention relates to an inkjet recording device which ejects ink droplets toward a recording medium from an inkjet recording head to implement recording of an image.

2. Description of the Related Art

Inkjet recording devices which eject ink droplets from nozzles of inkjet recording heads on recording mediums, such as paper and the like, for recording images have been known heretofore. Such an inkjet recording device ejects ink droplets from the nozzles to directly print on the paper. Therefore, in a case of two-sided printing, until one printed face (a front face) has been dried to a certain extent, it is not possible to print on the other face (a rear face). Consequently, methods have been proposed for drying the one printed face, such as temporarily ejecting the paper outside the device or the like (see, for example, Japanese Patent Application Laid-Open (JP-A) No. 2000-1010).

However, with a structure which temporarily ejects paper outside the device, a conveyance path of the paper is longer, and efficiency of two-sided printing on individual sheets of paper is inevitably reduced (in addition to ink drying time, there is an excess of conveyance time for the two-sided printing). As a result, there is a problem in that productivity falls at times of high-volume two-sided printing. Furthermore, in a paper inversion path for two-sided printing, the previously printed face is subject to frictional contact, and there may be a degradation of image quality on that face.

SUMMARY OF THE INVENTION

Accordingly, in view of the circumstances described above, the present invention provides an inkjet recording device which is capable, in two-sided printing, of avoiding degradation of image quality by rubbing of a printed face, and of preventing a fall in productivity.

An inkjet recording device of a first aspect of the present invention is an inkjet recording device for forming an image on a recording medium with an inkjet recording head, and includes: a conveyance section to which one face of the recording medium is adhered, the conveyance section conveying the recording medium to the inkjet recording head; and a switchback section to which the recording medium, on another face of which an image has been formed, is transferred from the conveyance section, the one face of the recording medium being adhered to the switchback section, and the switchback section re-supplying the recording medium to the conveyance section such that the other face of the recording medium can be adhered to the conveyance section.

According to the first aspect, in two-sided printing, the switchback section adheres and retains a face that has not been printed. Thus, it is possible to prevent image quality deterioration occurring as a result of rubbing of a printed face. Furthermore, because the recording medium can be quickly re-supplied to the conveyance section by the switchback section, a fall in productivity at times of two-sided printing can be avoided.

BRIEF DESCRIPTION OF THE DRAWINGS

Embodiments of the present invention will be described in detail based on the following figures, wherein.

DETAILED DESCRIPTION OF THE INVENTION

Figure 1:
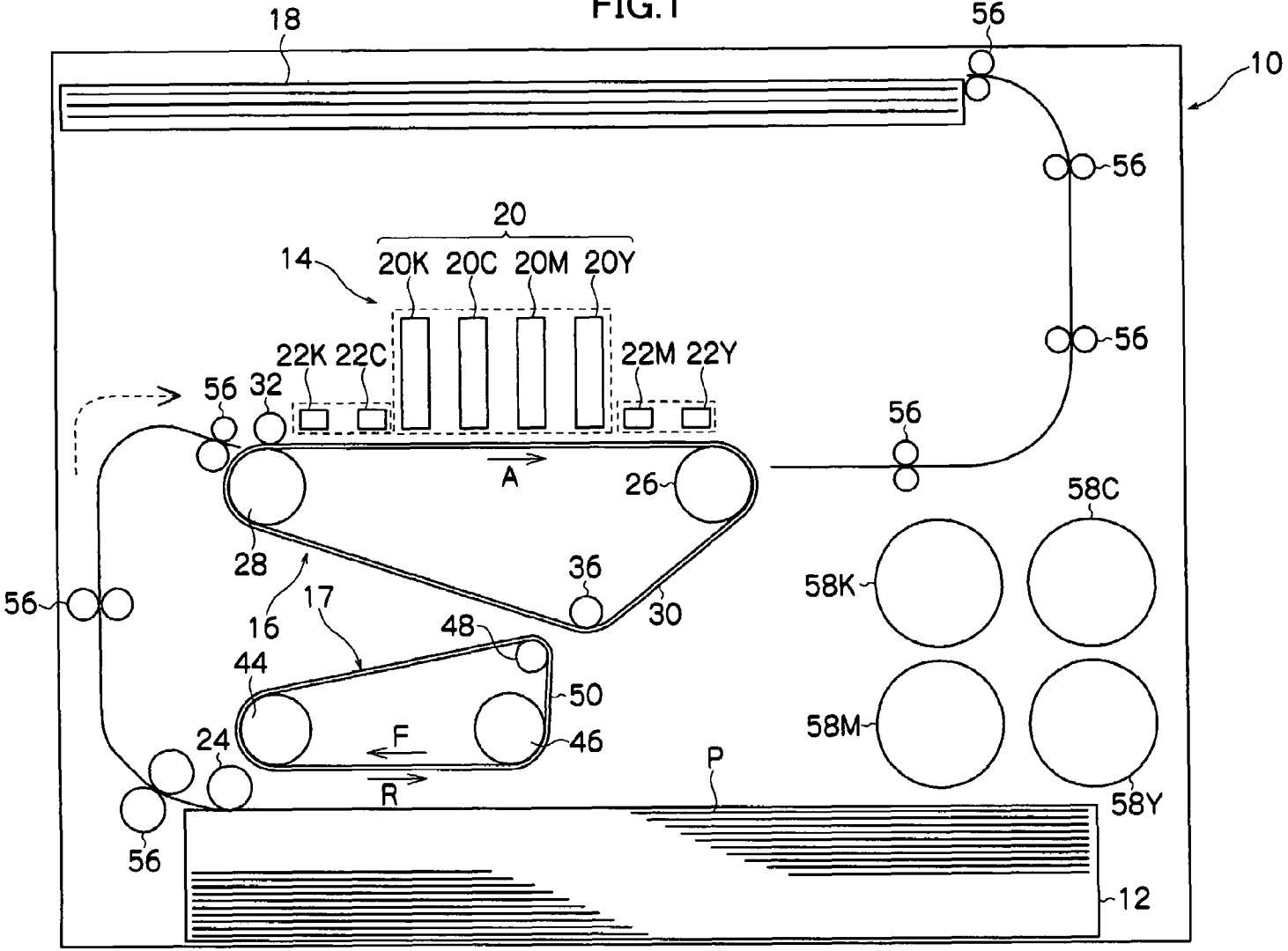
FIG. 1 is a schematic side view showing structure of an inkjet recording apparatus during printing.
Figure 2:
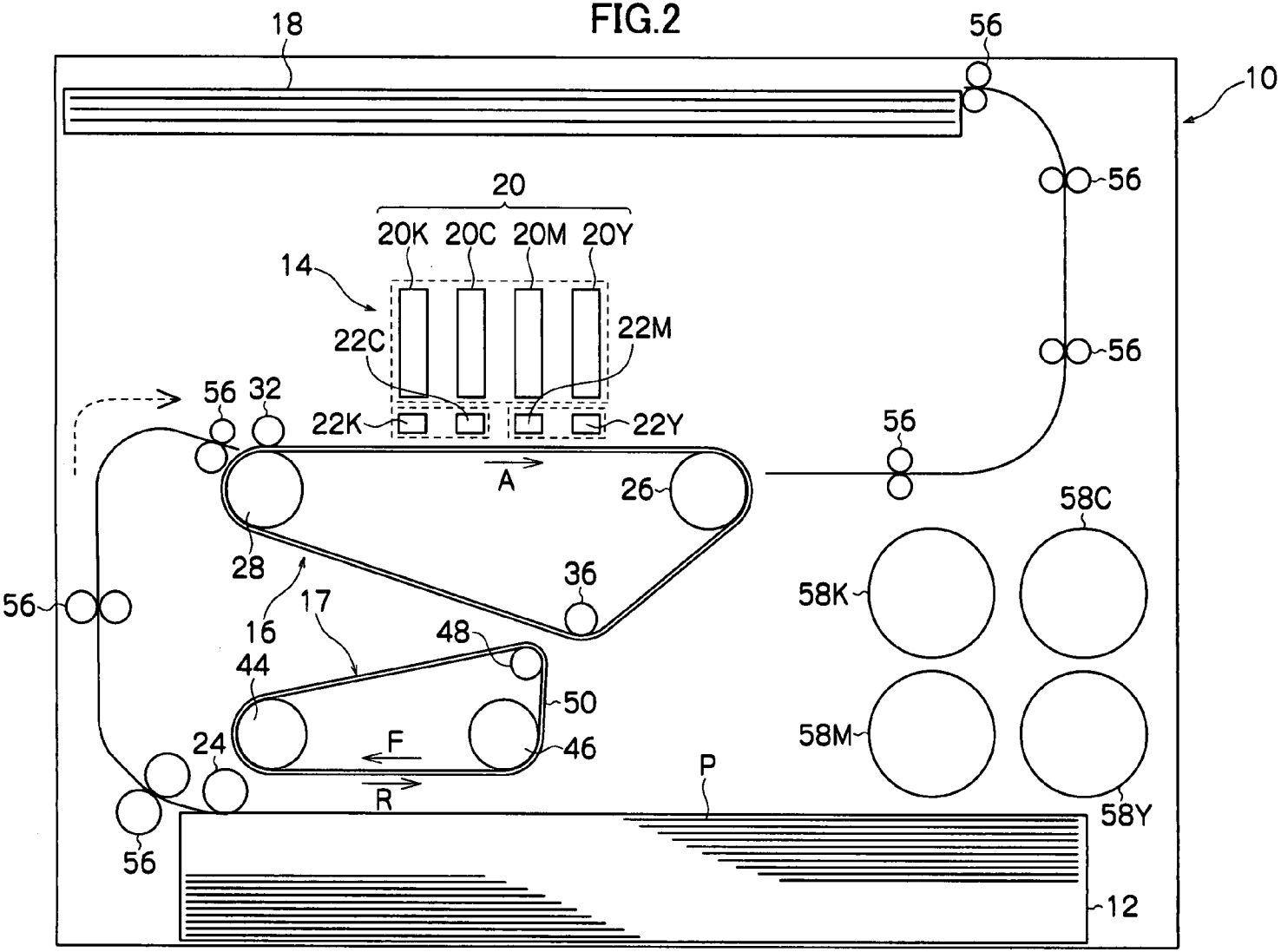
FIG. 2 is a schematic side view showing structure of the inkjet recording apparatus during maintenance.

Herebelow, detailed descriptions of the present invention will be given on the basis of the embodiments shown in the drawings. First, a first embodiment will be described. General structure of an inkjet recording device 10 relating to the present invention is shown in FIGS. 1 and 2. As is shown in FIGS. 1 and 2, the inkjet recording device 10 features a supply tray 12, a recording section 14, a conveyance section 16 and an ejection tray 18. The supply tray 12 accommodates paper P, which is an example of a recording medium. The recording section 14 records images on paper P that is supplied from the supply tray 12. The conveyance section 16 transports the paper P to the recording section 14. The ejection tray 18 accommodates the paper P on which images have been recorded by the recording section 14.

The recording section 14 features an inkjet recording head 20. The inkjet recording head 20 features a recording region which approximately matches, or exceeds, a maximum width of paper P for which image-recording by the inkjet recording device 10 is anticipated. In other words, the inkjet recording head 20 constitutes a "full-width array" (FWA) which is capable of single-pass printing.

In the inkjet recording head 20, a sequence of black (K), cyan (C), magenta (M) and yellow (Y) is arranged along a conveyance direction of the paper P from an upstream side thereof, and is structured so as to eject ink droplets by a well-known technique, such as a thermal system, a piezoelectric system or the like. As inks thereof, various inks may be employed, such as water-based inks, oil-based inks, solvent-type inks and the like. Ink tanks 58K, 58C, 58M and 58Y are provided in the inkjet recording device 10 for supplying ink to inkjet recording heads 20K, 20C, 20M and 20Y.

Maintenance units 22K to 22Y are provided at the inkjet recording heads 20K to 20Y. The maintenance units 22K to 22Y are divided into two groups, black (K) and cyan (C), and magenta (M) and yellow (Y). The maintenance units 22K to 22Y are structured to be movable between withdrawn positions for times of printing and positions for maintenance of the inkjet recording heads 20K to 20Y.

The maintenance units 22K to 22Y include dummy jet holders, wiping members, caps and so forth. When maintenance of the inkjet recording heads 20K to 20Y are to be done, the inkjet recording heads 20K to 20Y are lifted to a predetermined height, and then the maintenance units 22K to 22Y are disposed so as to respectively oppose nozzle faces (not illustrated) of the inkjet recording heads 20K to 20Y.

The paper P in the supply tray 12 is drawn out one sheet at a time by a pickup roller 24, and is fed to the recording section 14 by the conveyance section 16. The conveyance section 16 includes a conveyance belt 30 for opposing a printing face of the paper P with the inkjet recording head 20. This conveyance belt 30 is wound round a driving roller 26, which is disposed at a paper conveyance direction downstream side, and a passive roller 28, which is disposed at the paper conveyance direction upstream side. The conveyance belt 30 is structured so as to circulatingly drive (turn) in the direction of arrow A (the clockwise direction) in the drawings.

Figure 3:
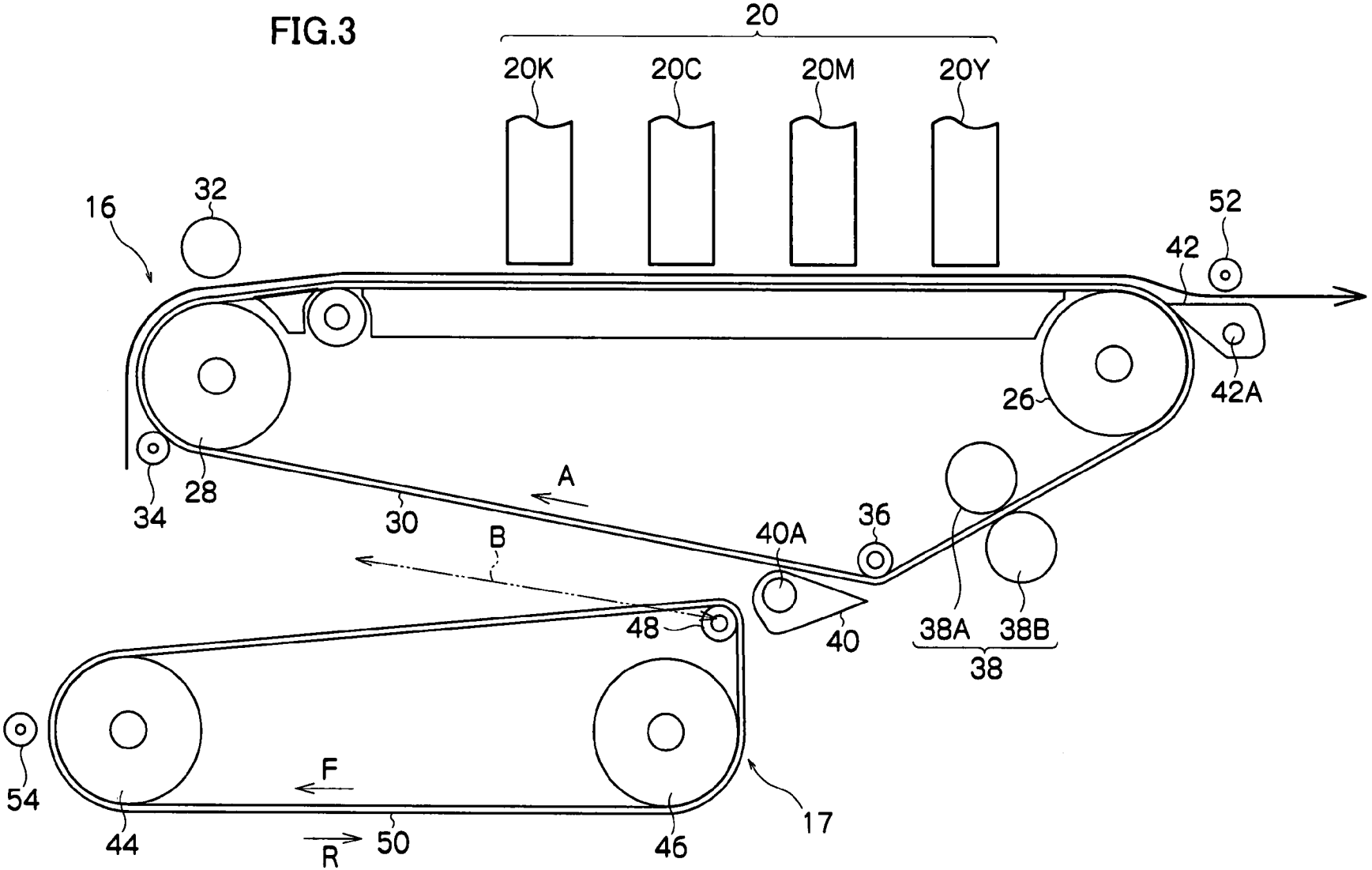
FIG. 3 is a schematic side view showing structure of a switchback section of a first embodiment, which is provided with an inversion belt.

As shown in FIG. 3, a nipping roller 32 is disposed upward of the passive roller 28. The nipping roller 32 is driven with the conveyance belt 30 by a front face side of the conveyance belt 30. A charging roller 34 is disposed downward of the passive roller 28. The charging roller 34 is driven with the conveyance belt 30 by the front face side of the conveyance belt 30.

The conveyance belt 30 is charged (electric charge is applied thereto) by the charging roller 34, and hence the paper P is electrostatically adhered to and conveyed by the conveyance belt 30. Here, a structure is possible in which the charging roller 34 is constantly contacted with and driven by the conveyance belt 30, and a structure is also possible in which the charging roller 34 moves away from the conveyance belt 30 each time the paper P is passing the charging roller 34.

At a lower portion of the conveyance belt 30, which is at a side thereof opposite to the side thereof at which the inkjet recording head 20 is disposed, a tension roller 36 is driven with the conveyance belt 30 by a rear face side of the conveyance belt 30. A pair of cleaning rollers 38 is disposed between the tension roller 36 and the driving roller 26. This pair of cleaning rollers 38 is structured by a fixed roller 38A and a swinging roller 38B. The fixed roller 38A is driven with the conveyance belt 30 by the rear face side thereof. The swinging roller 38B is driven with the conveyance belt 30 by the front face side thereof, and is structured to be suitably separable from the conveyance belt 30.

A first separation pawl 40, which serves as a first separation portion, is disposed at a downstream side of the tension roller 36 in the direction of turning of the conveyance belt 30. The first separation pawl 40 is pivoted on a rotation axle 40A, and is structured to be rotatable (swingable) between a position for slidingly contacting the conveyance belt 30 and a position which is separated from the conveyance belt 30.

A third separation pawl 42, which serves as a third separation portion, is disposed at a downstream side of the driving roller 26 in the direction of turning of the conveyance belt 30. Similarly to the first separation pawl 40, the third separation pawl 42 is pivoted on a rotation axle 42A, and is structured to be rotatable (swingable) between a position for slidingly contacting the conveyance belt 30 and a position which is separated from the conveyance belt 30. A second separation portion will be discussed later.

A switchback section 17 is disposed below the conveyance section 16. The switchback section 17 includes an inversion belt 50, which is for temporarily retaining the paper P and turning the paper P over at a time of two-sided printing. The inversion belt 50 is wound round a driving roller 44, a passive roller 46 and a tension roller 48. The inversion belt 50 is structured to be capable of circulatingly driving (turning) in the direction of arrow F and the direction of arrow R in the drawings (forward and reverse directions).

The inversion belt 50 is charged (electric charge is applied thereto) by a charging roller 54, which is driven by a front face side of the inversion belt 50 at a vicinity of the driving roller 44. The paper P is electrostatically adhered to and conveyed by the inversion belt 50. Here, rather than a structure in which the charging roller 54 is constantly in contact with and driven by the inversion belt 50, the charging roller 54 is a structure which moves away from the inversion belt 50 when the paper P is passing the charging roller 54, such that the charging roller 54 will not rub against a printed surface of the paper P that is adhered to the inversion belt 50. That is, the charging roller 54 is structured to be capable of approaching and separating from the inversion belt 50 (by swinging).

The tension roller 48 is a structure which is capable of reciprocatingly moving in a direction substantially parallel to the conveyance belt 30 spanning between the passive roller 28 and the tension roller 36 (i.e., the direction of arrow B shown in FIG. 3). When paper P is to be transferred from the inversion belt 50 to the conveyance belt 30, the tension roller 48 is disposed near the first separation pawl 40, as shown in FIG. 3.

When the tension roller 48 is disposed at this location, a radius of curvature of a portion of the inversion belt 50 that is wound round the tension roller 48 can be made small. As a result, the paper P will automatically peel off from this portion. Thus, in the first embodiment, the tension roller 48 constitutes the second separation portion, for separating the paper P from the inversion belt 50. Thus, this structure has the advantage of being simple.

Meanwhile, a spur wheel 52 is disposed upward of the third separation pawl 42 and conveyance roller pairs 56 are plurally (seven pairs in the structure in the drawings) disposed at suitable positions on a conveyance path of the paper P. Of the conveyance roller pairs 56 at the downstream side relative to the inkjet recording head 20 (four pairs in the structure in the drawings), it is preferable if a passive roller of each pair is a spur wheel.

Figure 4:
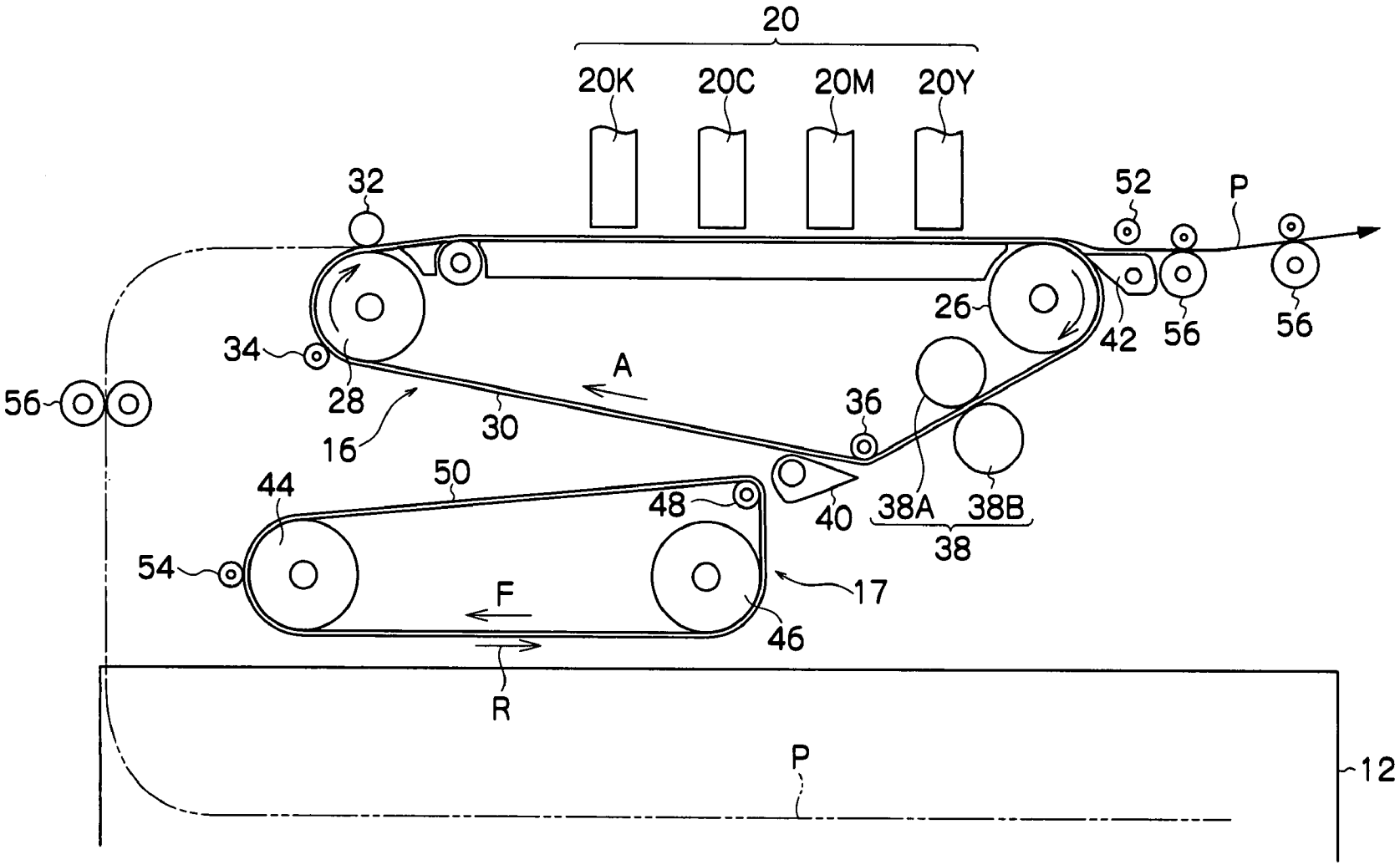
FIG. 4 is a schematic side view showing structure of the switchback section of the first embodiment at a time of single-pass one-sided printing.

Next, operations will be described for the inkjet recording device 10 with the structure described above. First, a case of single-pass one-sided printing will be described. In such a case, as shown in FIG. 4, the first separation pawl 40 is moved away from the conveyance belt 30, the third separation pawl 42 is slidingly contacted with the conveyance belt 30, and the pair of cleaning rollers 38 (i.e., the swinging roller 38B) is driven with the conveyance belt 30. Hence, in this state, paper P is supplied to the conveyance belt 30 by the pickup roller 24 and the conveyance roller pairs 56.

The paper P that has been fed onto the conveyance belt 30 and adheringly retained at the conveyance belt 30 is fed to a recording position of the inkjet recording head 20, and an image is recorded (printed) on one face (a front face) of the paper P. Then, after this image-recording has finished, the paper P is peeled from the conveyance belt 30 by the third separation pawl 42 and is conveyed to the ejection tray 18 by the conveyance roller pairs 56. Thus, single-pass one-sided printing is completed.

Figure 5:
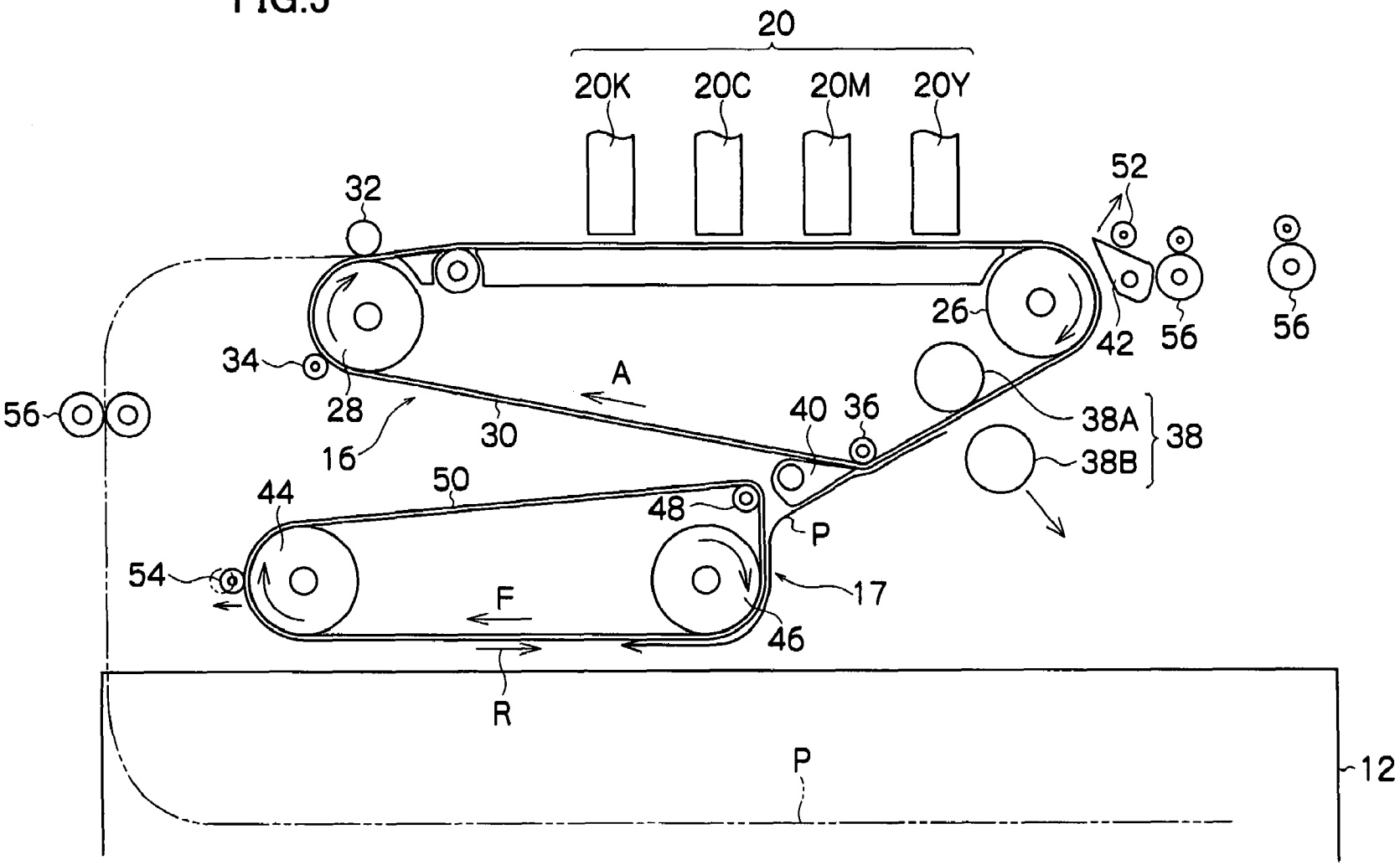
FIG. 5 is a schematic side view showing structure of the switchback section of the first embodiment at a time of single-pass two-sided printing.

Next, single-pass two-sided printing will be described for a case in which the paper P is intermittently conveyed, one sheet at a time. In such a case, first, as shown in FIG. 5, the first separation pawl 40 is slidingly contacted with the conveyance belt 30 and the third separation pawl 42 is moved away from the conveyance belt 30. The pair of cleaning rollers 38 (the swinging roller 38B) is moved away from the conveyance belt 30, and the charging roller 54 is driven with the inversion belt 50. Hence, in this state, paper P is supplied to the conveyance belt 30 by the pickup roller 24 and the conveyance roller pairs 56.

The paper P that has been fed onto the conveyance belt 30 and adheringly retained at the conveyance belt 30 is fed to the recording position of the inkjet recording head 20, and an image is recorded (printed) on one face (the front face) of the paper P. Then, the paper P is conveyed further, still being adheringly retained at the conveyance belt 30, and is peeled from the conveyance belt 30 by the first separation pawl 40 (see FIG. 5).

Figure 6A:
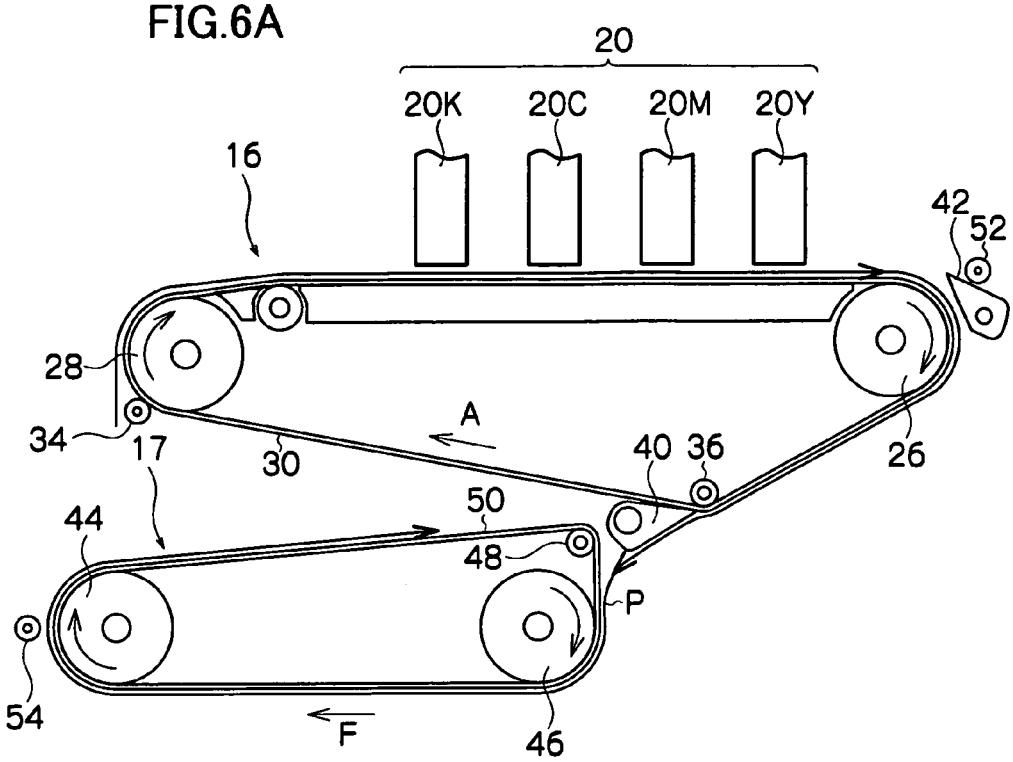
FIGS. 6A and 6B are schematic side views showing structure of the switchback section of the first embodiment at a time of single-pass two-sided printing.

The paper P that has been peeled from the conveyance belt 30 is adheringly retained at the inversion belt 50, which is maintained at a speed (linear speed) the same as that of the conveyance belt 30, and is conveyed in the direction of arrow F in the drawings. Here, the charging roller 54 is moved away from the inversion belt 50 before the paper P is transferred from the conveyance belt 30 to the inversion belt 50 (see FIG. 6A).

Figure 6B:
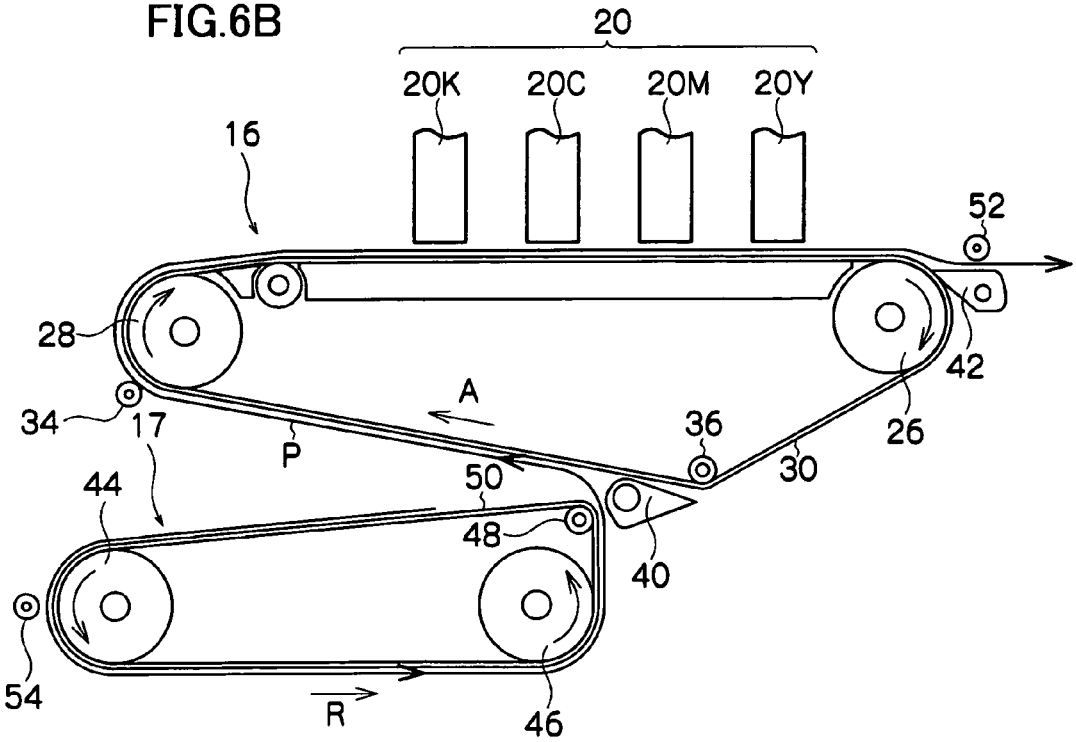

Then, at a time at which the paper P is completely adheringly retained onto the inversion belt 50, the inversion belt 50 turns in the direction of arrow R (switchbacks) at the same speed as the conveyance belt 30, as shown in FIG. 6B. Because the radius of curvature of the portion of the inversion belt 50 at which the tension roller 48 is disposed is small, the paper P is automatically peeled off from the inversion belt 50 at a location of this portion (by the second separation portion), and the paper P is again adheringly retained by the conveyance belt 30.

At this time, the front face side of the paper P, on which an image has been recorded (printed), is in surface contact with the conveyance belt 30 and is electrostatically adhered thereto. However, because the conveyance belt 30 and the inversion belt 50 are maintained at equal speeds, the image recorded (printed) on the front face does not rub against the conveyance belt 30. Therefore, a defect in image quality will not be caused. Further, the charging roller 34 may be moved away from the conveyance belt 30 when the paper P is fed back to the conveyance belt 30.

Hence, the paper P that has been adheringly retained back onto the conveyance belt 30 is again fed to the recording position of the inkjet recording head 20, and an image is recorded (printed) on the other face (a rear face) of the paper P. In the duration from the resumption of adhering retention of the paper P at the conveyance belt 30 until printing on the rear face is completed, the third separation pawl 42 is in sliding contact with the conveyance belt 30.

Hence, the paper P, whose rear face has had an image recorded thereon, is peeled from the conveyance belt 30 by the third separation pawl 42 and is conveyed by the conveyance roller pairs 56 to the ejection tray 18. Thus, single-pass two-sided printing is completed. Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30.

Next, single-pass two-sided printing will be described for a case in which a number of sheets of paper P are consecutively conveyed at one time. In such a case, first, the first separation pawl 40 is slidingly contacted with the conveyance belt 30 and the third separation pawl 42 is moved away from the conveyance belt 30. The pair of cleaning rollers 38 (the swinging roller 38B) is moved away from the conveyance belt 30 (see FIG. 5), the charging roller 54 is driven with the inversion belt 50, and the tension roller 48 is moved toward the driving roller 44 along the direction of arrow B (see FIG. 7A).

That is, the tension roller 48 is moved to a position which is close to the conveyance belt 30 and substantially intermediate to the driving roller 44 and the passive roller 46 (i.e., a position at which a radius of curvature of the inversion belt 50 is larger than at the initial position of the tension roller 48). Hence, in this state, plural sheets (for example, two sheets) of paper P1 and P2 are consecutively supplied to the conveyance belt 30 by the pickup roller 24 and the conveyance roller pairs 56.

Figure 7A:
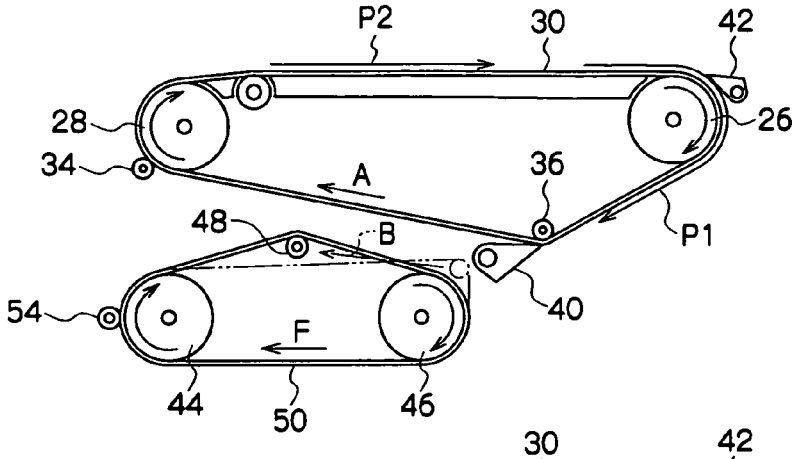
FIGS. 7A, 7B, 7C and 7D are schematic side views showing structure of the switchback section of the first embodiment at a time of single-pass two-sided printing in a case of simultaneous conveyance of a number of sheets.

As shown in FIG. 7A, the two sheets of paper P1 and P2 that have been fed onto the conveyance belt 30 and adheringly retained at the conveyance belt 30 are sequentially fed to the recording position of the inkjet recording head 20, and images are recorded (printed) on one faces (front faces) of the sheets. Then, the two sheets of paper P1 and P2 are further conveyed, still being adheringly retained at the conveyance belt 30, and are sequentially peeled from the conveyance belt 30 by the first separation pawl 40 (see FIG. 7B).

Figure 7B:
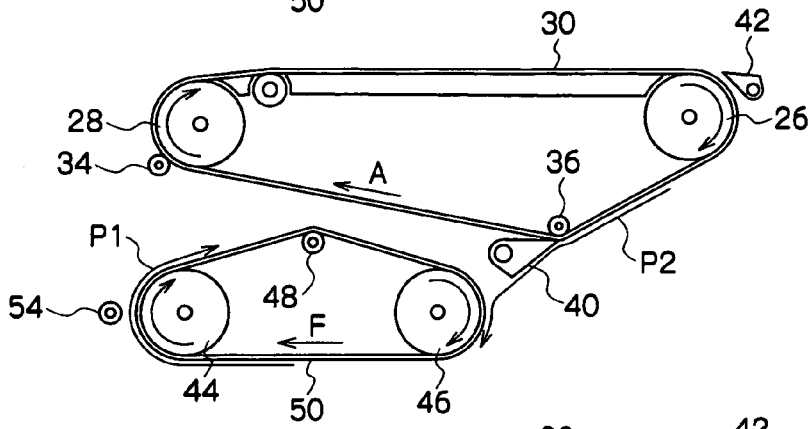

As shown in FIG. 7B, the two sheets of paper P1 and P2 that have been peeled from the conveyance belt 30 are sequentially adheringly retained at the inversion belt 50, which is maintained at the same speed as the conveyance belt 30, and are conveyed in the direction of arrow F in the drawings. Here, the charging roller 54 is moved away from the inversion belt 50 before the first sheet of paper P1 is transferred from the conveyance belt 30 to the inversion belt 50.

Figure 7C:
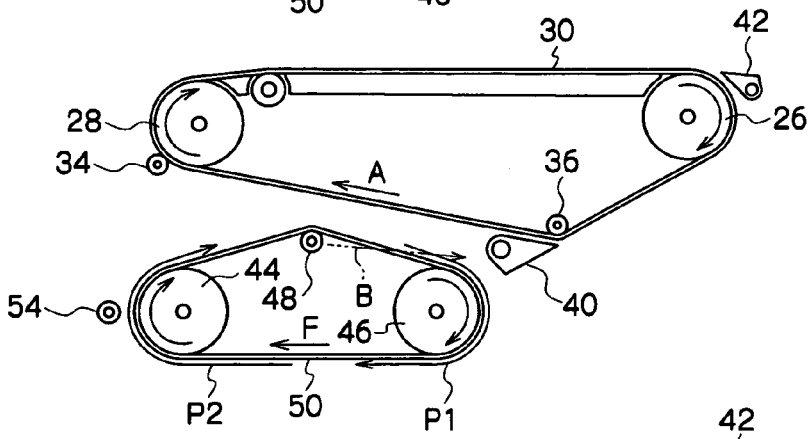

Then, as shown in FIG. 7C, after the second sheet of paper P2 has been completely adheringly retained onto the inversion belt 50, at a time at which a trailing end of the first sheet of paper P1 has passed the tension roller 48 but before a leading end of the second sheet of paper P2 approaches (comes close to, or, reaches) the tension roller 48, the tension roller 48 moves to the initial position thereof. At a time at which the tension roller 48 is disposed at the initial position, the inversion belt 50 turns in the direction of arrow R (switchbacks) at the same speed as the conveyance belt 30 (see FIG. 7D).

Figure 7D:
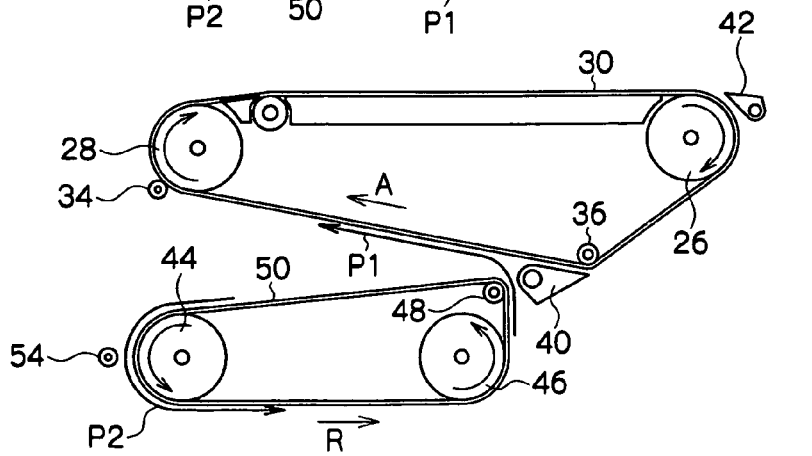

Accordingly, as shown in FIG. 7D, because the radius of curvature of the portion of the inversion belt 50 at which the tension roller 48 is disposed is small, the first sheet of paper P1 is automatically peeled off from the inversion belt 50 at a location of this portion (by the second separation portion), and is again adheringly retained by the conveyance belt 30. Subsequently, the second sheet of paper P2 is similarly peeled from the inversion belt 50 and adheringly retained at the conveyance belt 30 again.

Thus, even though the two sheets of paper P1 and P2 are consecutively transferred to the inversion belt 50 at one time in two-sided printing, it is possible, with a simple structure, to supply the first sheet of paper P1 and the second sheet of paper P2 back to the conveyance belt 30 without reversing the order thereof. As a result, it is possible to render complicated data processing for, for example, swapping printing data of the first sheet of paper P1 with printing data of the second sheet of paper P2 unnecessary, such that no extra burden is added to processing of the printing data.

Herein, a structure is possible in which the trailing end of the first sheet of paper P1 and the leading end of the second sheet of paper P2, or the like, are detected with a paper detection sensor (not shown), which serves as a recognition portion. A structure that performs calculation using sizes of the papers P1 and P2, the speed of turning of the inversion belt 50 and the like is also possible. Further, when the first sheet of paper P1 has been fad back to the conveyance belt 30, the charging roller 34 may be moved away from the conveyance belt 30, as described earlier.

When the two sheets of paper P1 and P2 are re-supplied to the conveyance belt 30, the front face sides thereof, on which images have been recorded (printed), are in surface contact with the conveyance belt 30 and are electrostatically adhered thereto. However, because the conveyance belt 30 and the inversion belt 50 are maintained at equal speeds, the images recorded (printed) on the front faces do not rub against the conveyance belt 30. Therefore, defects in image quality will not be caused.

Hence, the two sheets of paper P1 and P2 that have been adheringly retained back onto the conveyance belt 30 are again sequentially fed to the recording position of the inkjet recording head 20, and images are recorded (printed) on the other faces (rear faces) thereof. In the duration from the resumption of adhering retention of the first sheet of paper P1 to the conveyance belt 30 until printing on the rear faces is completed, the third separation pawl 42 is in sliding contact with the conveyance belt 30.

Hence, the two sheets of paper P1 and P2, whose rear faces have had images recorded thereon, are sequentially peeled from the conveyance belt 30 by the third separation pawl 42 and are conveyed to the ejection tray 18 by the conveyance roller pairs 56. Thus, single-pass two-sided printing of the plural consecutive sheets is completed. Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30.

Next, multi-pass two-sided printing will be described. In this case, first, the first separation pawl 40 and the third separation pawl 42 are both moved away from the conveyance belt 30. Further, the pair of cleaning rollers 38 (the swinging roller 38B) is moved away from the conveyance belt 30 (see FIG. 5) and the charging roller 54 is caused to be driven with the inversion belt 50. Hence, in this state, paper P is supplied to the conveyance belt 30 by the pickup roller 24 and the conveyance roller pairs 56.

Figure 8A:
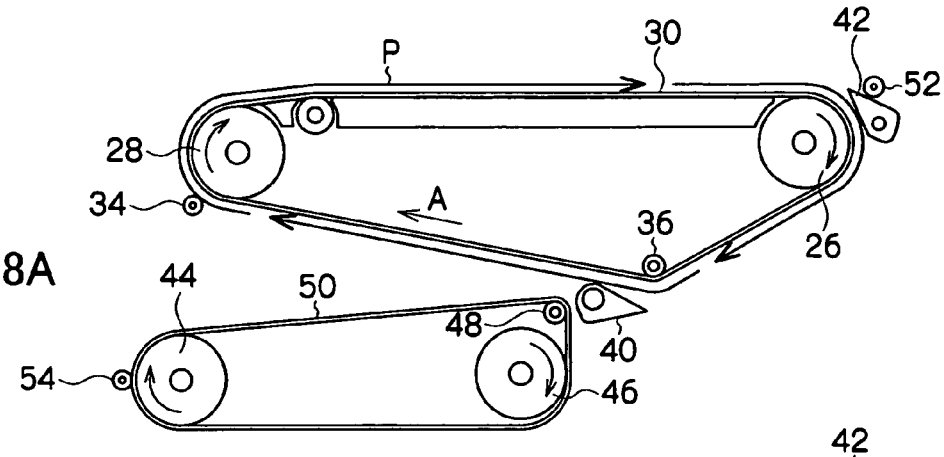
FIGS. 8A, 8B, 8C and 8D are schematic side views showing structure of the switchback section of the first embodiment at a time of multi-pass two-sided printing.

The paper P that has been fed onto the conveyance belt 30 and adheringly retained at the conveyance belt 30 is, as shown in FIG. 8A, fed to the recording position of the inkjet recording head 20, and an image is recorded (printed) on one face (the front face) of the paper P. Then, the paper P is conveyed further, still being adheringly retained at the conveyance belt 30, and fed to the recording position of the inkjet recording head 20 a number of times. At this time, the charging roller 34 may be moved away from the conveyance belt 30 each time the paper P passes the charging roller 34.

Figure 8B:
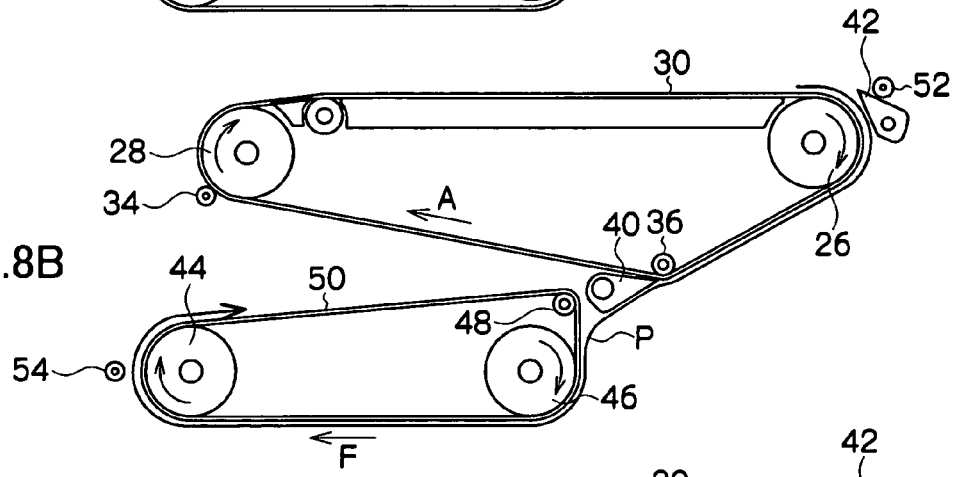

On the occasion of a final printing on the front face, when the paper P has passed through a region of the first separation pawl 40, the first separation pawl 40 slidingly contacts the conveyance belt 30 before the final printing is completed, as shown in FIG. 8B. Accordingly, after the final printing on the front face, the paper P that has been adheringly retained and conveyed by the conveyance belt 30 is peeled from the conveyance belt 30 by the first separation pawl 40. The paper P that has been separated from the conveyance belt 30 is adheringly retained at the inversion belt 50, which is maintained at the same speed as the conveyance belt 30, and is conveyed in the direction of arrow F in the drawings.

Figure 8C:
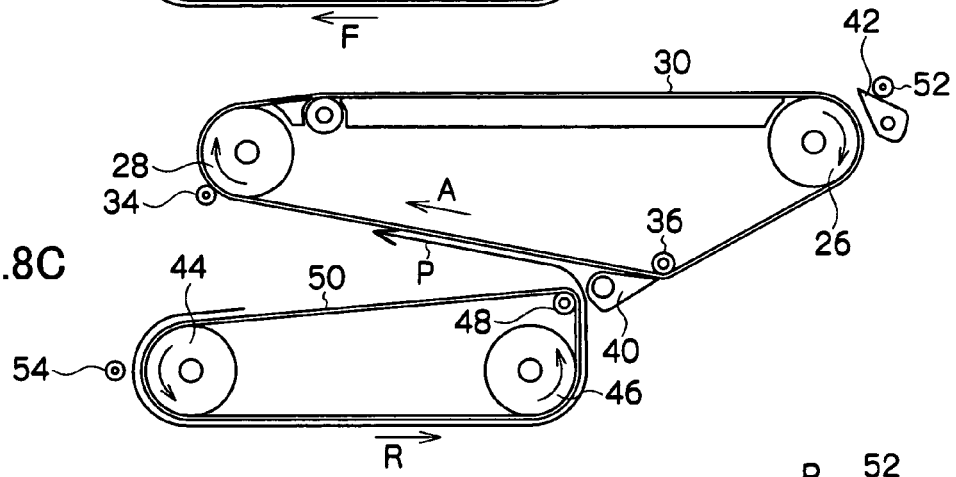

Here, the charging roller 54 is moved away from the inversion belt 50 before the paper P is transferred from the conveyance belt 30 to the inversion belt 50. Then, at a time at which the paper P is completely adheringly retained onto the inversion belt 50, the inversion belt 50 turns in the direction of arrow R (switchbacks) at the same speed as the conveyance belt 30, as shown in FIG. 8C. Because the radius of curvature of the portion of the inversion belt 50 at which the tension roller 48 is disposed is small, the paper P is automatically peeled off from the inversion belt 50 at a location of this portion (by the second separation portion), and the paper P is again adheringly retained at the conveyance belt 30.

At this time, the front face side of the paper P, on which an image has been recorded (printed), is in surface contact with the conveyance belt 30 and is electrostatically adhered thereto. However, because the conveyance belt 30 and the inversion belt 50 are kept at equal speeds, the image recorded (printed) on the front face does not rub against the conveyance belt 30. Therefore, a defect in image quality will not be caused.

Hence, the paper P that has been adheringly retained back onto the conveyance belt 30 is again fed to the recording position of the inkjet recording head 20, and an image is recorded (printed) on the other face (the rear face) thereof. Then, as shown in FIG. 8A, the paper P remains adheringly retained at the conveyance belt 30 and is further conveyed and fed to the recording position of the inkjet recording head 20 a number of times. Similarly to the time of printing on the front face, the charging roller 34 may be moved away from the conveyance belt 30 each time the paper P passes the charging roller 34.

Figure 8D:
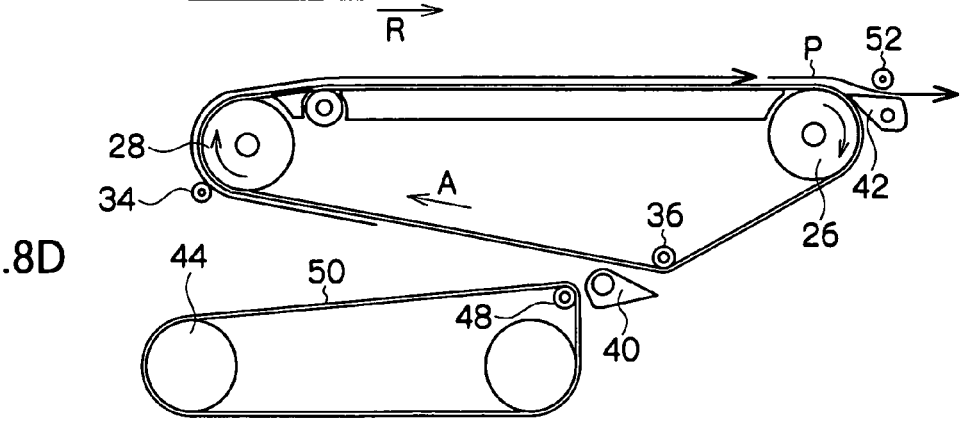

On the occasion of a final printing on the rear face, when the paper P has passed through a region of the third separation pawl 42, the third separation pawl 42 slidingly contacts the conveyance belt 30 before the final printing is completed, as shown in FIG. 8D. Accordingly, after the final printing on the rear face, the paper P that has been adheringly retained and conveyed by the conveyance belt 30 is peeled from the conveyance belt 30 by the third separation pawl 42. The paper P that has been separated from the conveyance belt 30 is conveyed to the ejection tray 18 by the conveyance roller pairs 56.

Thus, multi-pass two-sided printing is completed. Here, when the third separation pawl 42 is rubbing against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30.

Figure 9:
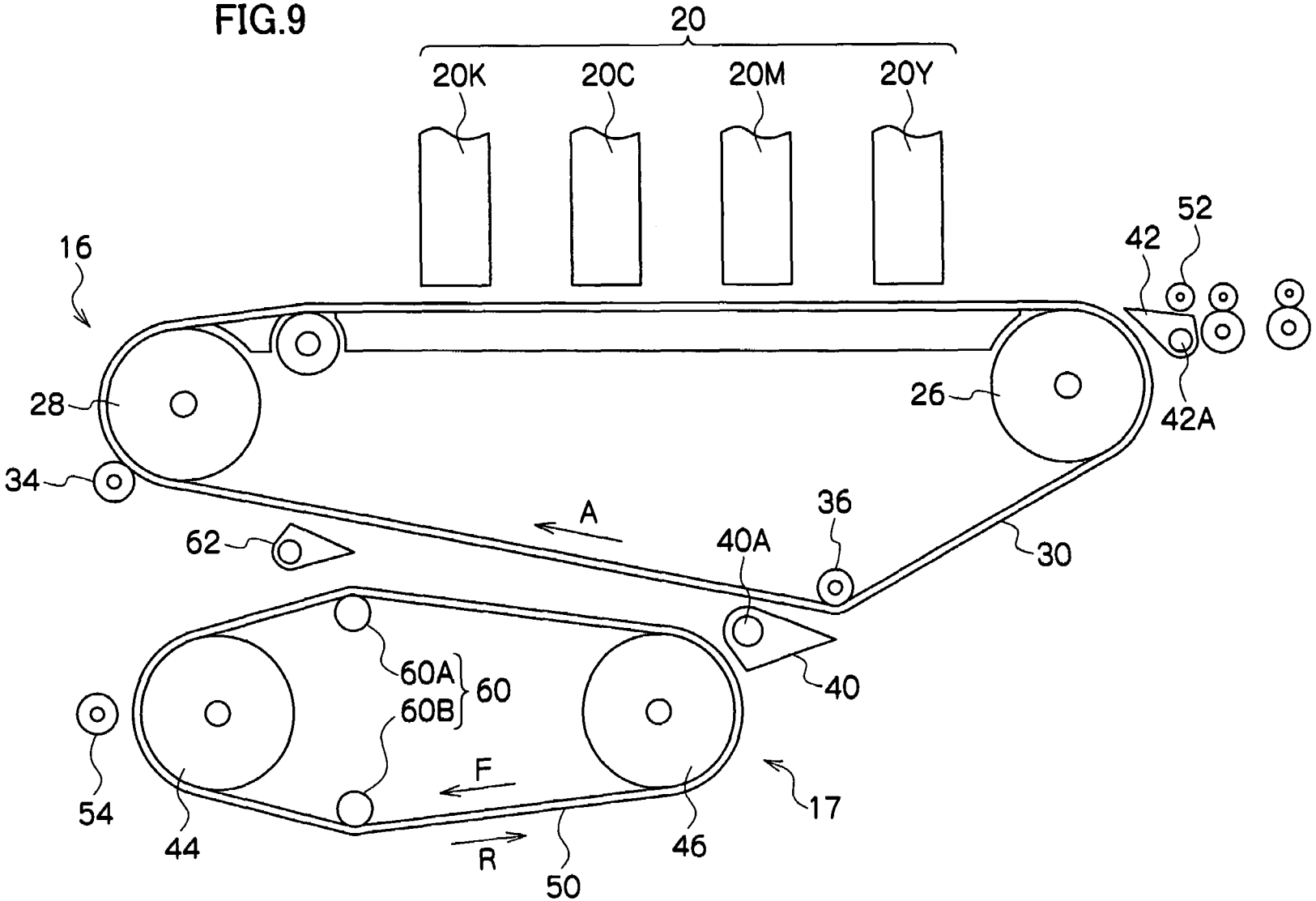
FIG. 9 is a schematic side view showing structure of a switchback section of a second embodiment, which is provided with an inversion belt.

Next, a second embodiment will be described. As shown in FIG. 9, the second embodiment differs from the first embodiment described above only in that a pair of tension rollers 60 are provided at the switchback section 17 (instead of the tension roller 48), somewhat toward the driving roller 44, and in that a second separation pawl 62 is provided to serve as the second separation portion. Accordingly, portions that are the same as in the above-described first embodiment are assigned the same reference numerals, and descriptions thereof are omitted as appropriate. The cleaning rollers 38 are not illustrated in FIG. 9.

The two tension rollers 60 are disposed apart from one another by a predetermined separation, so as to broaden the inversion belt 50 in a vertical direction, and are structured so as to be movable in the vertical direction while remaining in a state in which this predetermined separation is maintained. That is, this pair of tension rollers 60A and 60B is supported at an unillustrated frame to be vertically separated by the predetermined separation and supported in a direction perpendicular to the surfaces of the drawings. Thus, the pair of tension rollers 60 is structured so as to be movable toward and away from the conveyance belt 30 by movement of this frame in the vertical direction.

The second separation pawl 62 is fixedly disposed to be capable of slidingly contacting a portion of the inversion belt 50 at which the upper tension roller 60A is disposed when the pair of tension rollers 60 is raised (i.e., when the tension rollers 60 are moved closer to the conveyance belt 30). The second separation pawl 62 is structured to aid peeling of paper P from the inversion belt 50 and to guide the paper P for supplying (transferring) the paper P to the conveyance belt 30.

Next, for the second embodiment with the structure described above, operations will be described. In this description of the operations, many portions are duplicative of the first embodiment. Therefore, only single-pass two-sided printing in the case in which the paper P is intermittently conveyed one sheet at a time, single-pass two-sided printing in the case in which a number of sheets of the paper P are consecutively conveyed at one time, and multi-pass two-sided printing will be described. Descriptions of other printing modes will be omitted.

First of all, single-pass two-sided printing will be described for the case in which the paper P is intermittently conveyed one sheet at a time. In this case, the first separation pawl 40 is slidingly contacted with the conveyance belt 30, and the third separation pawl 42 is moved away from the conveyance belt 30. The pair of cleaning rollers 38 (the swinging roller 38B) is moved away from the conveyance belt 30 (see FIG. 5) and the charging roller 54 is caused to be driven with the inversion belt 50. Further, the pair of tension rollers 60 is retained at a lower position (see FIG. 10A), which is separated from the second separation pawl 62 (and the conveyance belt 30).

Figure 10A:
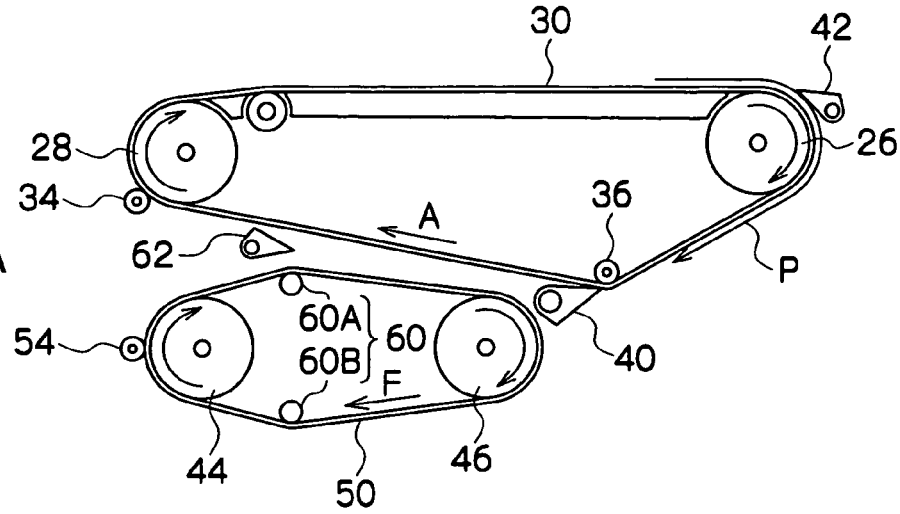
FIGS. 10A, 10B and 10C are schematic side views showing structure of the switchback section of the second embodiment at a time of single-pass two-sided printing.

Hence, in this state, paper P is supplied to the conveyance belt 30 by the pickup roller 24 and the conveyance roller pairs 56. As shown in FIG. 10A, the paper P that has been fed onto the conveyance belt 30 and adheringly retained at the conveyance belt 30 is fed to the recording position of the inkjet recording head 20, and an image is recorded (printed) on one face (the front face) of the paper P. Then, the paper P is conveyed further, still being adheringly retained at the conveyance belt 30, and is peeled from the conveyance belt 30 by the first separation pawl 40 (see FIG. 10B).

Figure 10B:
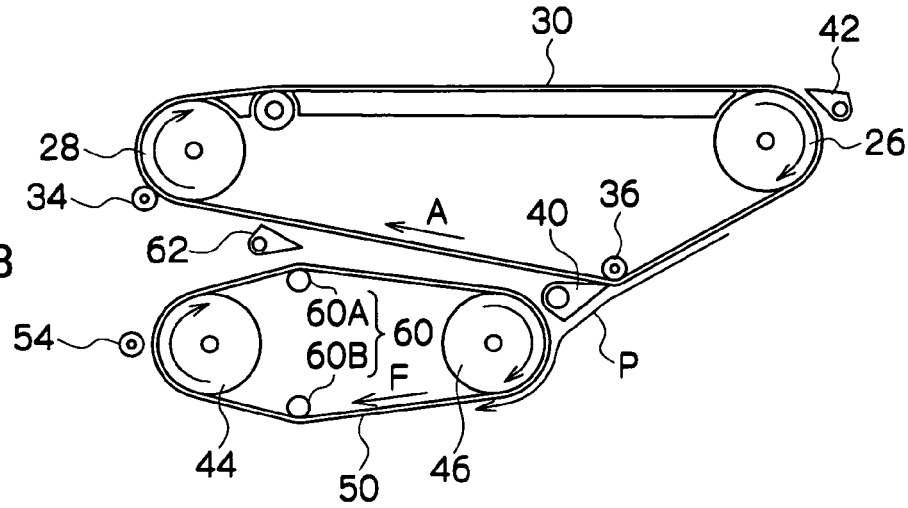
Figure 10C:
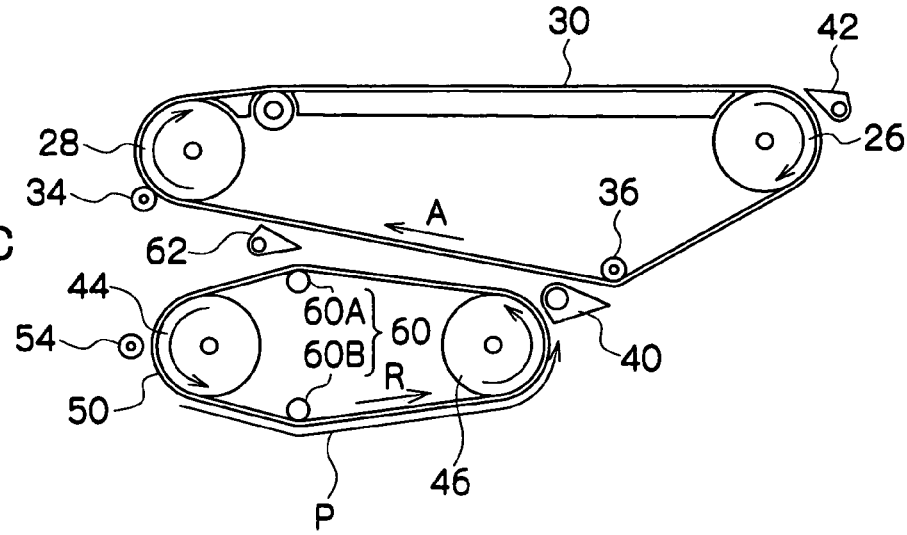

The paper P that has been peeled from the conveyance belt 30 is, as shown in FIG. 10B, adheringly retained at the inversion belt 50, which is maintained at the same speed as the conveyance belt 30, and is conveyed in the direction of arrow F in the drawings. Here, the charging roller 54 is moved away from the inversion belt 50 before the paper P is transferred from the conveyance belt 30 to the inversion belt 50. Then, at a time at which the paper P is completely adheringly retained on the inversion belt 50, the inversion belt 50 turns in the direction of arrow R (switchbacks) at the same speed as the conveyance belt 30, as shown in FIG. 10C.

Figure 11A:
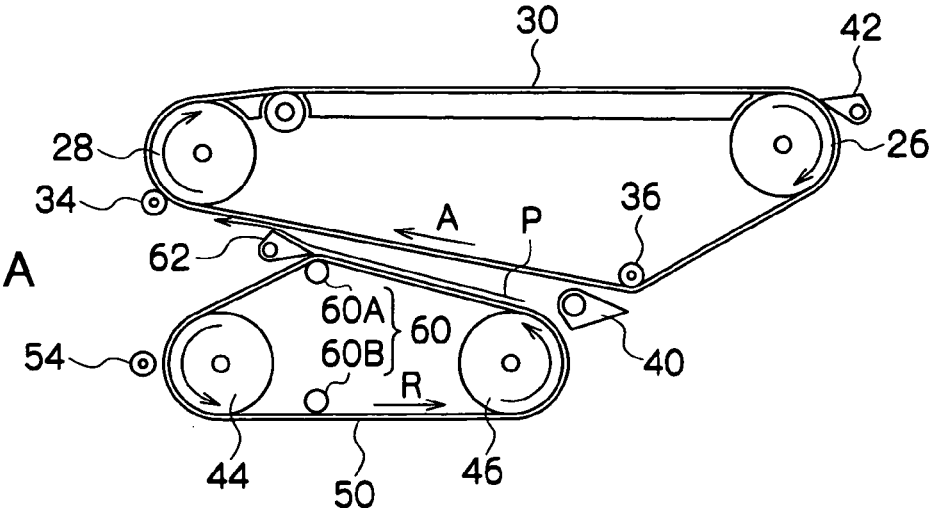
FIGS. 11A, 11B and 11C are schematic side views showing structure of the switchback section of the second embodiment at a time of single-pass two-sided printing.

Then, as shown in FIG. 11A, contemporaneously with this reverse turning, the pair of tension rollers 60 is raised so as to approach the conveyance belt 30, and a portion of the inversion belt 50 at which the upper tension roller 60A is disposed is caused to slidingly contact the second separation pawl 62. Here, in the case in which the paper P is to be transferred between the conveyance belt 30 and the inversion belt 50 and back one sheet at a time, the pair of tension rollers 60 may have been retained at this upper position, with the inversion belt 50 sliding against the second separation pawl 62, from the beginning.

Thus, when the pair of tension rollers 60 is retained at the upper position, a radius of curvature of the inversion belt 50 against which the second separation pawl 62 is sliding is made smaller by the upper tension roller 60A, and the paper P is automatically peeled off from the inversion belt 50 at this location, which is to say a location which is closer to the passive roller 28 than the location of the transfer from the conveyance belt 30 to the inversion belt 50. The peeling of the paper P is aided by the second separation pawl 62, and the paper P is guided by the second separation pawl 62 and adheringly retained at the conveyance belt 30 again. Here, a structure in which the lower tension roller 60B is not in contact with the inversion belt 50 at this time is possible.

When the paper P is re-supplied to the conveyance belt 30, the front face side of the paper P, on which an image has been recorded (printed), is in surface contact with the conveyance belt 30 and is electrostatically adhered thereto. However, a speed of rotation of the driving roller 44 is regulated such that the speed of the inversion belt 50 does not change when the second separation pawl 62 rubs against the inversion belt 50, and the conveyance belt 30 and the inversion belt 50 are maintained at equal speeds. Consequently, the image recorded (printed) on the front face does not rub against the conveyance belt 30. Therefore, a defect in image quality will not be caused. The charging roller 34 may be moved away from the conveyance belt 30 when the paper P is fed back to the conveyance belt 30.

Figure 11B:
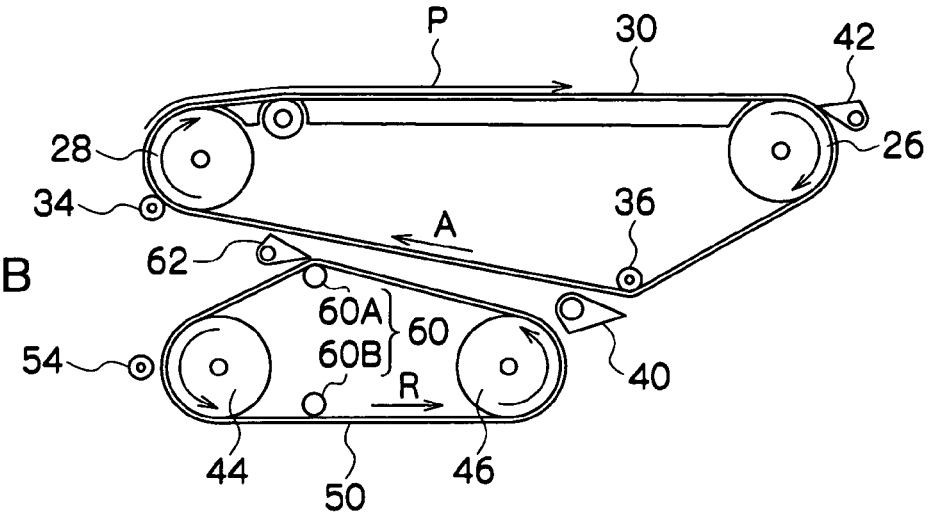

Hence, the paper P that has been adheringly retained back onto the conveyance belt 30 is again fed to the recording position of the inkjet recording head 20, as shown in FIG. 11B, and an image is recorded (printed) on the other face (the rear face) thereof. In the duration from the resumption of adhering retention of the paper P to the conveyance belt 30 until printing on the rear face is completed, the third separation pawl 42 is in sliding contact with the conveyance belt 30.

Figure 11C:
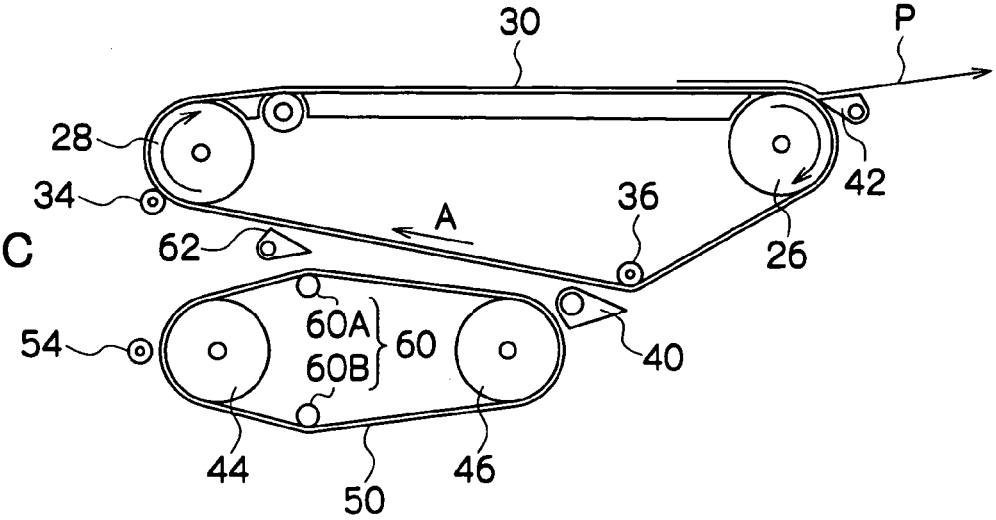

Hence, the paper P, whose rear face has had an image recorded thereon, is peeled from the conveyance belt 30 by the third separation pawl 42, as shown in FIG. 11C, and is conveyed by the conveyance roller pairs 56 to the ejection tray 18. Thus, single-pass two-sided printing for the case of intermittently feeding the paper P one sheet at a time is completed.

Here, when the third separation pawl 42 is in sliding contact with the conveyance belt 30, the first separation pawl 40 is separated from the conveyance belt 30 and, as shown in FIGS. 3 and 4, the pair of cleaning rollers 38 (the swinging roller 38B) is driven with the conveyance belt 30. Further, as shown in FIG. 11C, the pair of tension rollers 60 is moved to the lower position.

Next, single-pass two-sided printing will be described for the case in which a number of sheets of the paper P are consecutively conveyed at one time. In this case, first, the first separation pawl 40 is slidingly contacted with the conveyance belt 30 and the third separation pawl 42 is moved away from the conveyance belt 30. The pair of cleaning rollers 38 (the swinging roller 38B) is moved away from the conveyance belt 30 (see FIG. 5), the charging roller 54 is driven with the inversion belt 50, and the pair of tension rollers 60 is moved away from the second separation pawl 62 (and the conveyance belt 30) to the lower position (see FIG. 12A).

Figure 12A:
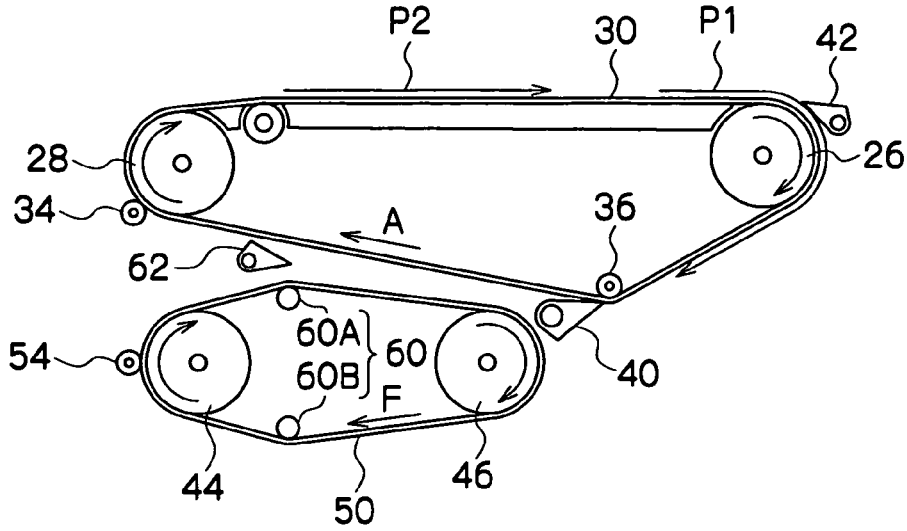
FIGS. 12A, 12B and 12C are schematic side views showing structure of the switchback section of the second embodiment at a time of single-pass two-sided printing in a case of simultaneous conveyance of a number of sheets.

Hence, in this state, plural sheets (for example, two sheets) of paper P1 and P2 are consecutively supplied to the conveyance belt 30 by the pickup roller 24 and the conveyance roller pairs 56. As shown in FIG. 12A, the two sheets of paper P1 and P2 that have been fed onto the conveyance belt 30 and adheringly retained at the conveyance belt 30 are sequentially fed to the recording position of the inkjet recording head 20, and images are recorded (printed) on one faces (the front faces) of the sheets. Then, the two sheets of paper P1 and P2 are further conveyed, still being adheringly retained at the conveyance belt 30, and are sequentially peeled from the conveyance belt 30 by the first separation pawl 40 (see FIG. 12B).

Figure 12B:
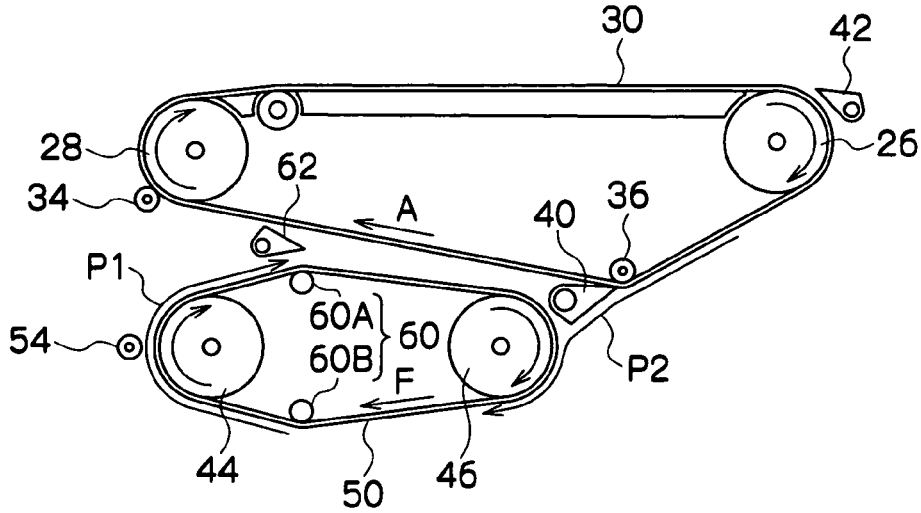

As shown in FIG. 12B, the two sheets of paper P1 and P2 that have been separated from the conveyance belt 30 are sequentially adheringly retained at the inversion belt 50, which is maintained at the same speed as the conveyance belt 30, and are conveyed in the direction of arrow F in the drawings. At this time, the charging roller 54 is moved away from the inversion belt 50 before the first sheet of paper P1 is transferred from the conveyance belt 30 to the inversion belt 50.

Figure 12C:
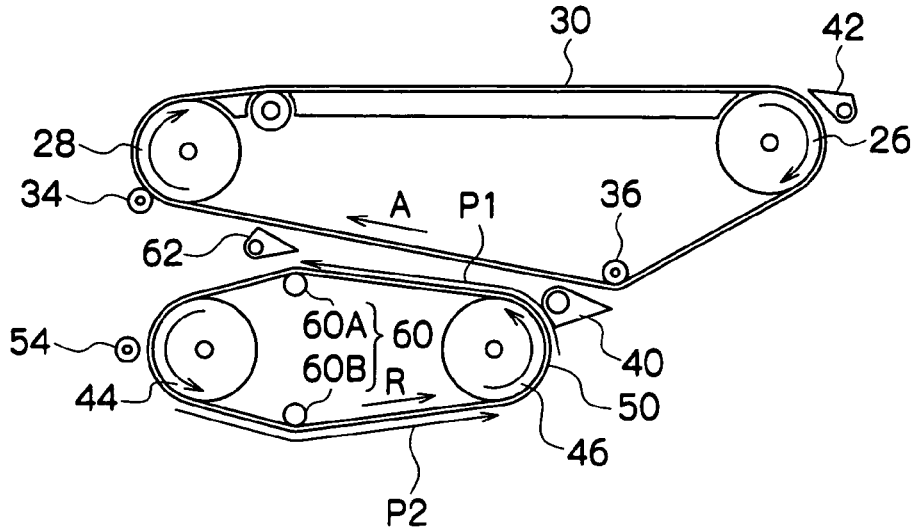

Then, as shown in FIG. 12C, after the second sheet of paper P2 has been completely adheringly retained onto the inversion belt 50, at a time at which the trailing end of the first sheet of paper P1 has passed the second separation pawl 62 (and the upper tension roller 60A) but the leading end of the second sheet of paper P2 has not reached the second separation pawl 62 (and the upper tension roller 60A), the inversion belt 50 turns in the direction of arrow R (switchbacks) at the same speed as the conveyance belt 30.

Figure 13A:
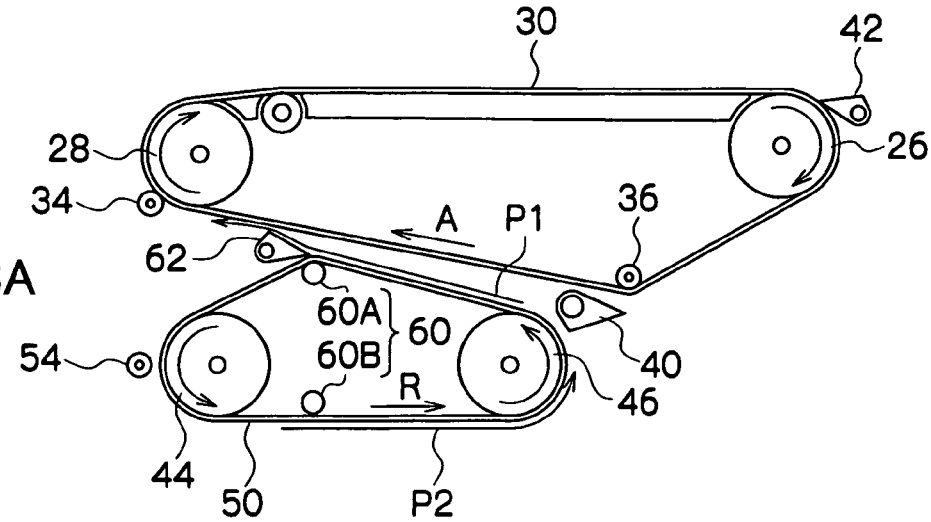
FIGS. 13A, 13B and 13C are schematic side views showing structure of the switchback section of the second embodiment at the time of single-pass two-sided printing in the case of simultaneous conveyance of a number of sheets.

Then, as shown in FIG. 13A, contemporaneously with this reverse turning, the pair of tension rollers 60 is raised so as to approach the conveyance belt 30, and the portion of the inversion belt 50 at which the upper tension roller 60A is disposed is caused to slidingly contact the second separation pawl 62. Here, as mentioned above, a structure in which the lower tension roller 60B is not in contact with the inversion belt 50 at this time is possible.

Figure 13B:
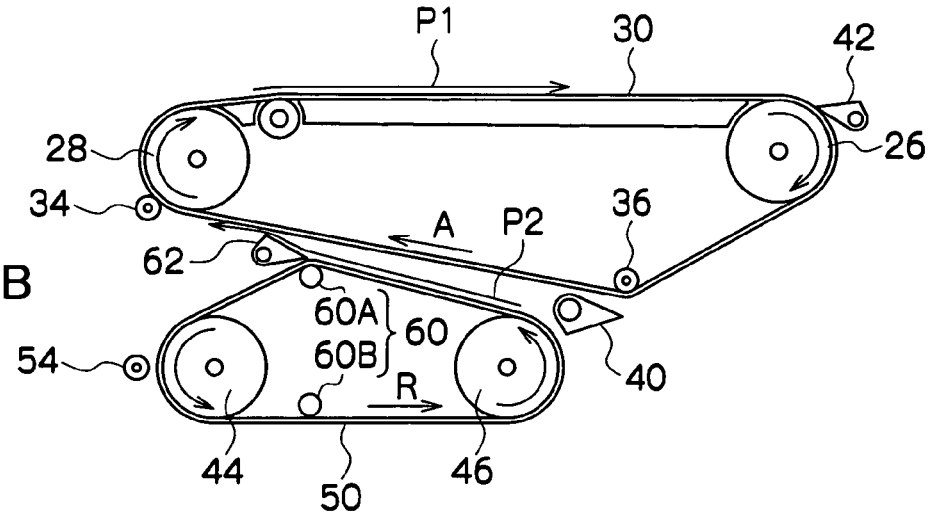

Thus, when the pair of tension rollers 60 is retained at the upper position, the radius of curvature of the inversion belt 50 against which the second separation pawl 62 is sliding is made smaller by the upper tension roller 60A, and the first sheet of paper P1 is automatically peeled off from the inversion belt 50 at this location, which is to say the location which is closer to the passive roller 28 than the location of the transfer from the conveyance belt 30 to the inversion belt 50. The peeling of the first sheet of paper P1 is aided by the second separation pawl 62, and the first sheet of paper P1 is guided by the second separation pawl 62 and adheringly retained at the conveyance belt 30 again. Subsequently, as shown in FIG. 13B, the second sheet of paper P2 is similarly peeled from the inversion belt 50 and adheringly retained at the conveyance belt 30 again.

Thus, even though the two sheets of paper P1 and P2 are consecutively transferred to the inversion belt 50 at one time in two-sided printing, it is possible, with a simple structure, to supply the first sheet of paper P1 and the second sheet of paper P2 back to the conveyance belt 30 without reversing the order thereof. As a result, it is possible to render complicated data processing for, for example, swapping printing data of the first sheet of paper P1 with printing data of the second sheet of paper P2 unnecessary, such that no extra burden is added to processing of the printing data.

Herein, a structure is possible in which the trailing end of the first sheet of paper P1 and the leading end of the second sheet of paper P2, or the like, are detected with a paper detection sensor (not shown), which serves as the recognition portion. A structure that performs calculation using sizes of the papers P1 and P2, the speed of turning of the inversion belt 50 and the like is also possible. Further, the charging roller 34 may be moved away from the conveyance belt 30 when the first sheet of paper P1 has been re-supplied to the conveyance belt 30, as described earlier.

When the two sheets of paper P1 and P2 are re-supplied to the conveyance belt 30, the front face sides thereof, on which images have been recorded (printed), are in surface contact with the conveyance belt 30 and are electrostatically adhered thereto. However, the speed of rotation of the driving roller 44 is regulated such that the speed of the inversion belt 50 does not change when the second separation pawl 62 rubs against the inversion belt 50, and the conveyance belt 30 and the inversion belt 50 are maintained at equal speeds. Consequently, the images recorded (printed) on the front faces do not rub against the conveyance belt 30. Therefore, defects in image quality will not be caused.

Hence, the two sheets of paper P1 and P2 that have been adheringly retained back onto the conveyance belt 30 are again sequentially fed to the recording position of the inkjet recording head 20, and images are recorded (printed) on the other faces (rear faces) thereof. In the duration from the resumption of adhering retention of the first sheet of paper P1 at the conveyance belt 30 until printing on the rear faces is completed, the third separation pawl 42 is in sliding contact with the conveyance belt 30.

Figure 13C:
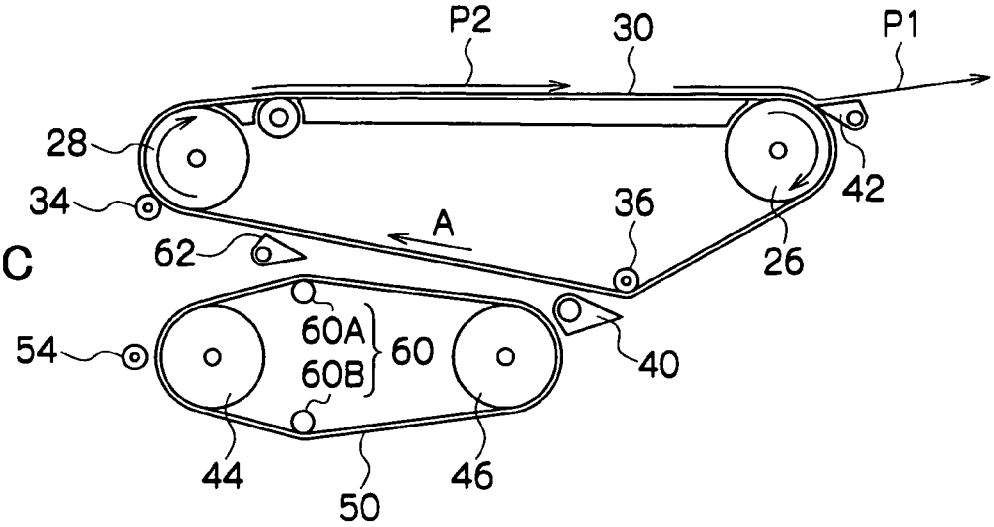

Hence, the two sheets of paper P, whose rear faces have had images recorded thereon, are sequentially peeled from the conveyance belt 30 by the third separation pawl 42, as shown in FIG. 13C, and are conveyed by the conveyance roller pairs 56 to the ejection tray 18. Thus, single-pass two-sided printing of plural consecutive sheets is completed.

Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30. Further, as shown in FIG. 13C, the pair of tension rollers 60 is moved to the lower position.

Next, multi-pass two-sided printing will be described. This printing mode differs from the single-pass two-sided printing described above only in that the paper P is fed to the recording position of the inkjet recording head 20 a number of times, and is accordingly not illustrated.

First, the first separation pawl 40 and the third separation pawl 42 are both moved away from the conveyance belt 30. Further, the pair of cleaning rollers 38 (the swinging roller 38B) is moved away from the conveyance belt 30 (see FIG. 5) and the charging roller 54 is driven with the inversion belt 50. Hence, in this state, paper P is supplied to the conveyance belt 30 by the pickup roller 24 and the conveyance roller pairs 56.

The paper P that has been fed onto the conveyance belt 30 and adheringly retained at the conveyance belt 30 is fed to the recording position of the inkjet recording head 20, and an image is recorded (printed) on one face (the front face) of the paper P. Then, the paper P is further conveyed, still being adheringly retained at the conveyance belt 30, and fed to the recording position of the inkjet recording head 20 a number of times. At this time, the charging roller 34 may be moved away from the conveyance belt 30 each time the paper P passes the charging roller 34.

On the occasion of a final printing on the front face, when the paper P has passed through a region of the first separation pawl 40, the first separation pawl 40 slidingly contacts the conveyance belt 30 before the final printing is completed. Accordingly, after the final printing on the front face, the paper P that has been adheringly retained and conveyed by the conveyance belt 30 is peeled from the conveyance belt 30 by the first separation pawl 40. The paper P that has been peeled from the conveyance belt 30 is adheringly retained at the inversion belt 50, which is maintained at the same speed as the conveyance belt 30, and is conveyed in the direction of arrow F.

Here, the charging roller 54 is moved away from the inversion belt 50 before the paper P is transferred from the conveyance belt 30 to the inversion belt 50. Then, at a time at which the paper P is completely adheringly retained onto the inversion belt 50, the inversion belt 50 turns in the direction of arrow R (switchbacks) at the same speed as the conveyance belt 30.

Then, contemporaneously with this reverse turning, the pair of tension rollers 60 is raised so as to approach the conveyance belt 30, and the portion of the inversion belt 50 at which the upper tension roller 60A is disposed is caused to slidingly contact the second separation pawl 62. Here, in the case in which the paper P is being transferred between the conveyance belt 30 and the inversion belt 50 one sheet at a time, the pair of tension rollers 60 may have been retained at this upper position, with the inversion belt 50 sliding against the second separation pawl 62, from the beginning, as described earlier.

Thus, when the pair of tension rollers 60 is retained at the upper position, the radius of curvature of the inversion belt 50 against which the second separation pawl 62 is sliding is made smaller by the upper tension roller 60A, and the paper P is automatically peeled off from the inversion belt 50 at this location, which is to say the location which is closer to the passive roller 28 than the location of the transfer from the conveyance belt 30 to the inversion belt 50. The peeling of the paper P is aided by the second separation pawl 62, and the paper P is guided by the second separation pawl 62 and adheringly retained at the conveyance belt 30 again. Here, a structure in which the lower tension roller 60B is not in contact with the inversion belt 50 at this time is possible, as described earlier.

When the paper P is re-supplied to the conveyance belt 30, the front face side of the paper P, on which an image has been recorded (printed), is in surface contact with the conveyance belt 30 and is electrostatically adhered thereto. However, the speed of rotation of the driving roller 44 is regulated such that the speed of the inversion belt 50 does not change when the second separation pawl 62 rubs against the inversion belt 50, and the conveyance belt 30 and the inversion belt 50 are kept at equal speeds. Consequently, the image recorded (printed) on the front face does not rub against the conveyance belt 30. Therefore, a defect in image quality will not be caused.

Hence, the paper P that has been adheringly retained back onto the conveyance belt 30 is again fed to the recording position of the inkjet recording head 20 and an image is recorded (printed) on the other face (the rear face) thereof. Then, the paper P remains adheringly retained at the conveyance belt 30 and is further conveyed and fed to the recording position of the inkjet recording head 20 a number of times. Similarly to the time of printing on the front face, the charging roller 34 may be moved away from the conveyance belt 30 each time the paper P passes the charging roller 34.

On the occasion of a final printing on the rear face, when the paper P has passed through a region of the third separation pawl 42, the third separation pawl 42 slidingly contacts the conveyance belt 30 before the final printing is completed. Accordingly, after the final printing on the rear face, the paper P that has been adheringly retained and conveyed by the conveyance belt 30 is peeled from the conveyance belt 30 by the third separation pawl 42 and conveyed to the ejection tray 18 by the conveyance roller pairs 56.

Thus, multi-pass two-sided printing is completed. Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30. Further, the pair of tension rollers 60 is moved to the lower position.

Figure 14:
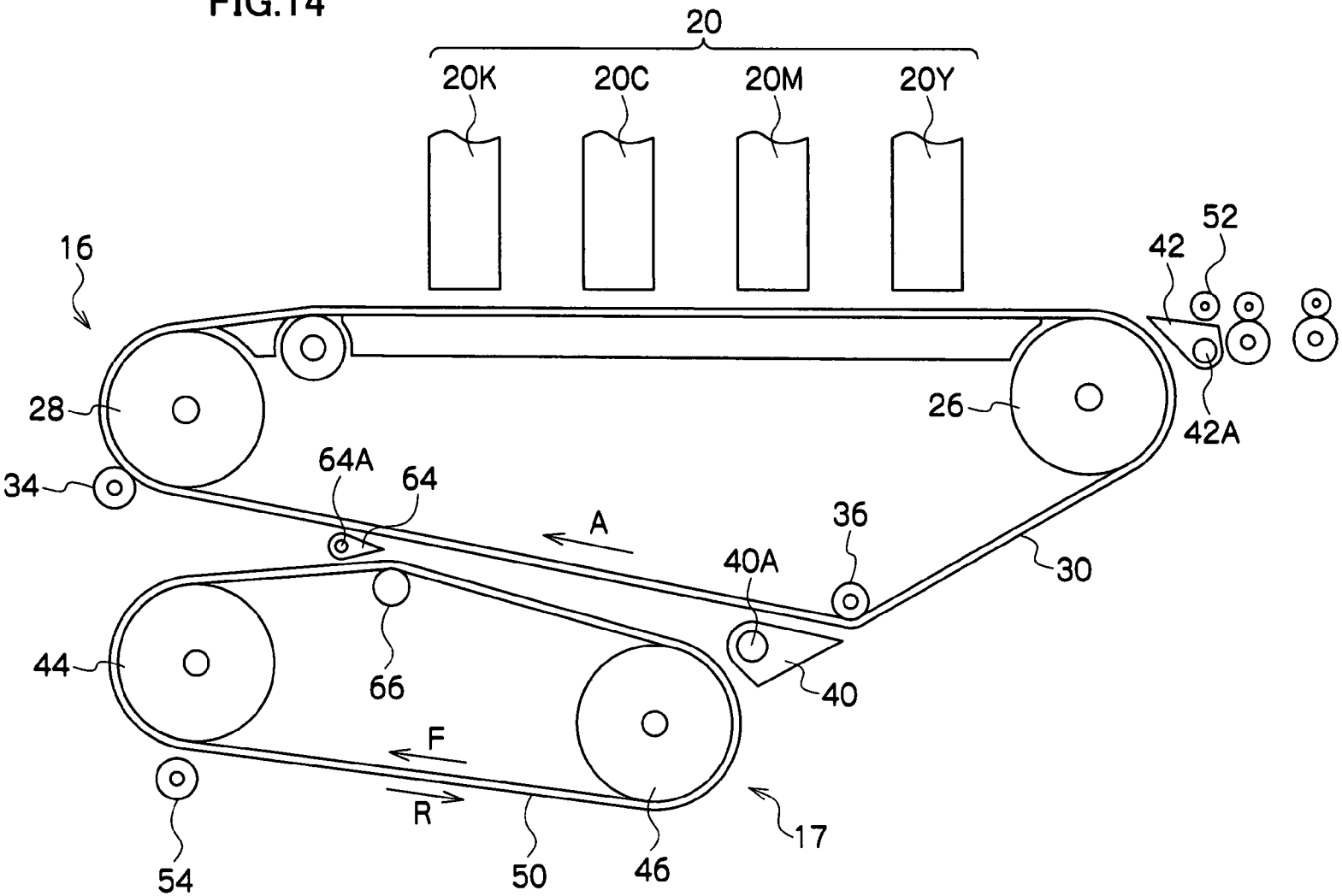
FIG. 14 is a schematic side view showing structure of a switchback section of a third embodiment, which is provided with an inversion belt.

Next, a third embodiment will be described. As shown in FIG. 14, the third embodiment differs from the first embodiment described earlier only in that a second separation pawl 64, which serves as the second separation portion, is rotatably provided at the switchback section 17, somewhat toward the passive roller 28, and in that a tension roller 66 is fixedly disposed in a vicinity of the second separation pawl 64, instead of the tension roller 48. Accordingly, portions that are the same as in the above-described first embodiment are assigned the same reference numerals, and descriptions thereof are omitted as appropriate. The cleaning rollers 38 are not illustrated in FIG. 14.

Similarly to the first separation pawl 40 and the third separation pawl 42, the second separation pawl 64 is pivoted on a rotation axle 64A, and is structured to be rotatable (swingable) between a position for slidingly contacting the inversion belt 50 and a position which is separated from the inversion belt 50. The tension roller 66 is fixedly disposed in a vicinity of the second separation pawl 64, which is to say at a predetermined position such that the tension roller 66 is close to the conveyance belt 30 (a location near the passive roller 28), such that the second separation pawl 64 can slidingly contact the inversion belt 50 when the second separation pawl 64 is rotated downward.

Next, for the third embodiment with the structure described above, operations will be described. In this description of the operations, many portions are duplicative of the first embodiment and/or the second embodiment. Therefore, only single-pass two-sided printing in the case in which a number of sheets of paper P are consecutively conveyed at one time and multi-pass two-sided printing will be described. Descriptions of other printing modes will be omitted.

First of all, single-pass two-sided printing will be described for the case in which a number of sheets of the paper P are consecutively conveyed at one time. In this case, first, the first separation pawl 40 is slidingly contacted with the conveyance belt 30 and the third separation pawl 42 is moved away from the conveyance belt 30. The pair of cleaning rollers 38 (the swinging roller 38B) is moved away from the conveyance belt 30 (see FIG. 5), the charging roller 54 is driven with the inversion belt 50, and the second separation pawl 64 is separated from the inversion belt 50 (see FIG. 15A).

Figure 15A:
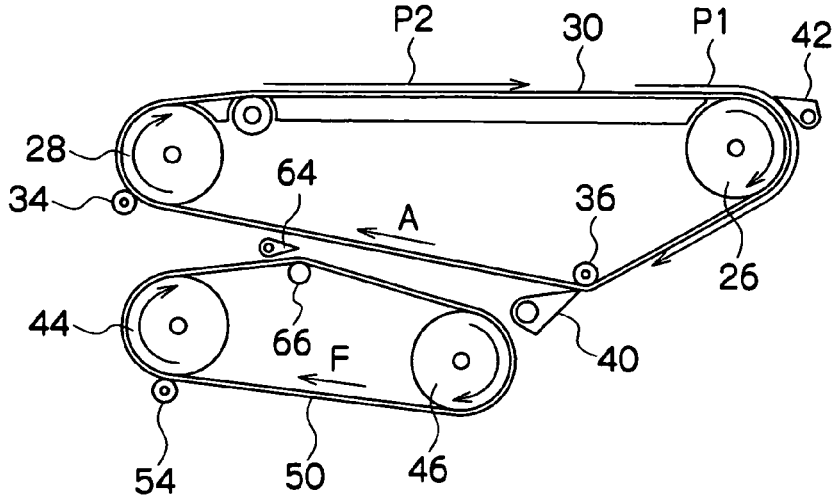
FIGS. 15A, 15B and 15C are schematic side views showing structure of the switchback section of the third embodiment at a time of single-pass two-sided printing in a case of simultaneous conveyance of a number of sheets.

Hence, in this state, plural sheets (for example, two sheets) of paper P1 and P2 are consecutively supplied to the conveyance belt 30 by the pickup roller 24 and the conveyance roller pairs 56. As shown in FIG. 15A, the two sheets of paper P1 and P2 that have been fed onto the conveyance belt 30 and adheringly retained at the conveyance belt 30 are sequentially fed to the recording position of the inkjet recording head 20, and images are recorded (printed) on one faces (the front faces) of the sheets. Then, the two sheets of paper P1 and P2 are further conveyed, still being adheringly retained at the conveyance belt 30, and are sequentially peeled from the conveyance belt 30 by the first separation pawl 40 (see FIG. 15B).

Figure 15B:
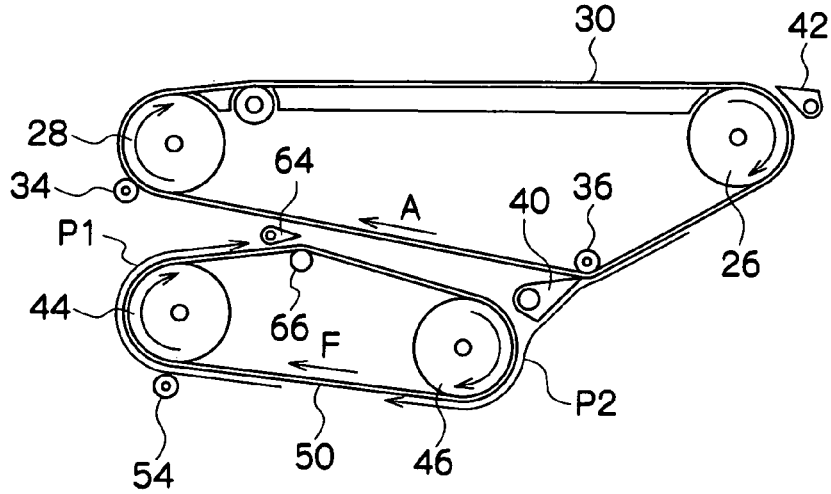

As shown in FIG. 15B, the two sheets of paper P1 and P2 that have been peeled from the conveyance belt 30 are sequentially adheringly retained at the inversion belt 50, which is maintained at the same speed as the conveyance belt 30, and are conveyed in the direction of arrow F in the drawings. At this time, the charging roller 54 is moved away from the inversion belt 50 before the first sheet of paper P1 is transferred from the conveyance belt 30 to the inversion belt 50.

Figure 15C:
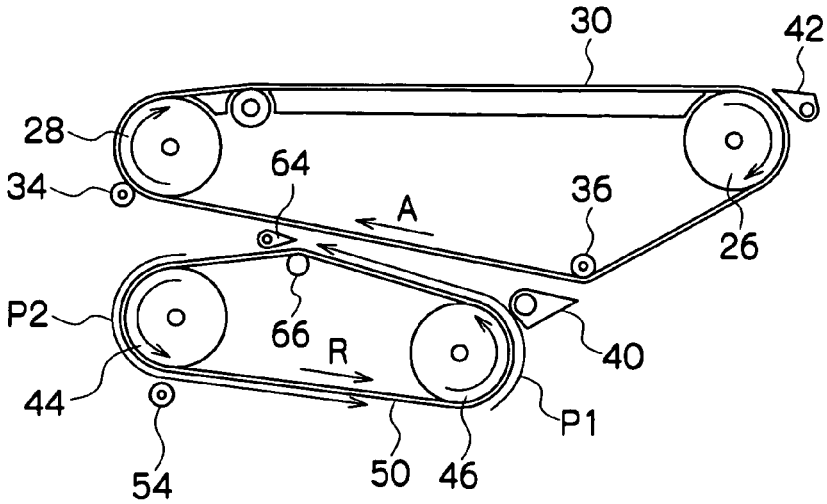

Then, as shown in FIG. 15C, after the second sheet of paper P2 has been completely adheringly retained onto the inversion belt 50, at a time at which the trailing end of the first sheet of paper P1 has passed the second separation pawl 64 (and the tension roller 66) but the leading end of the second sheet of paper P2 has not reached the second separation pawl 64 (and the tension roller 66), the inversion belt 50 turns in the direction of arrow R (switchbacks) at the same speed as the conveyance belt 30.

Figure 16A:
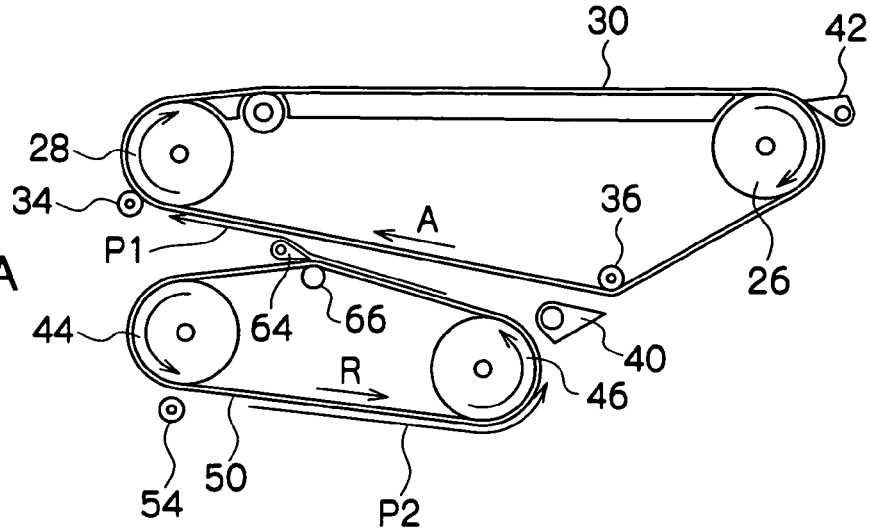
FIGS. 16A, 16B and 16C are schematic side views showing structure of the switchback section of the third embodiment at the time of single-pass two-sided printing in the case of simultaneous conveyance of a number of sheets.

Then, as shown in FIG. 16A, contemporaneously with this reverse turning, the second separation pawl 64 is rotated downward (toward the inversion belt 50), and the portion of the inversion belt 50 at which the tension roller 66 is disposed is caused to slidingly contact the second separation pawl 64.

Figure 16B:
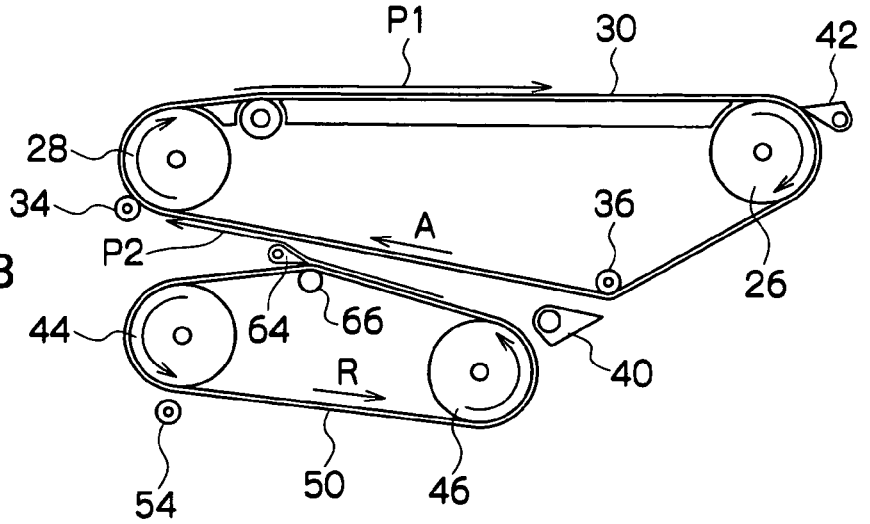

As a result, the first sheet of paper P1 is peeled off from the inversion belt 50 by the second separation pawl 64 (the second separation portion), at a location which is closer to the passive roller 28 than the location of the transfer from the conveyance belt 30 to the inversion belt 50, and is adheringly retained at the conveyance belt 30 again. Subsequently, as shown in FIG. 16B, the second sheet of paper P2 is similarly peeled from the inversion belt 50 and adheringly retained at the conveyance belt 30 again.

Thus, even though the two sheets of paper P1 and P2 are consecutively transferred to the inversion belt 50 at one time in two-sided printing, it is possible, with a simple structure, to supply the first sheet of paper P1 and the second sheet of paper P2 back to the conveyance belt 30 without reversing the order thereof. As a result, it is possible to render complicated data processing for, for example, swapping printing data of the first sheet of paper P1 with printing data of the second sheet of paper P2 unnecessary, such that no extra burden is added to processing of the printing data.

Herein, a structure is possible in which the trailing end of the first sheet of paper P1 and the leading end of the second sheet of paper P2, or the like, are detected with a paper detection sensor (not shown), which serves as the recognition portion. A structure that performs calculation using sizes of the papers P1 and P2, the speed of turning of the inversion belt 50 and the like is also possible. Further, when the first sheet of paper P1 has been re-supplied to the conveyance belt 30, the charging roller 34 may be moved away from the conveyance belt 30, as described earlier.

When the two sheets of paper P1 and P2 are re-supplied to the conveyance belt 30, the front face sides thereof, on which images have been recorded (printed), are in surface contact with the conveyance belt 30 and are electrostatically adhered thereto. However, the speed of rotation of the driving roller 44 is regulated such that the speed of the inversion belt 50 does not alter when the second separation pawl 64 rubs against the inversion belt 50, and the conveyance belt 30 and the inversion belt 50 are kept at equal speeds. Consequently, the images recorded (printed) on the front faces do not rub against the conveyance belt 30. Therefore, defects in image quality will not be caused.

Hence, the two sheets of paper P1 and P2 that have been adheringly retained back onto the conveyance belt 30 are again sequentially fed to the recording position of the inkjet recording head 20, and images are recorded (printed) on the other faces (rear faces) thereof. In the duration from the resumption of adhering retention of the first sheet of paper P1 at the conveyance belt 30 until printing on the rear faces is completed, the third separation pawl 42 is in sliding contact with the conveyance belt 30.

Figure 16C:
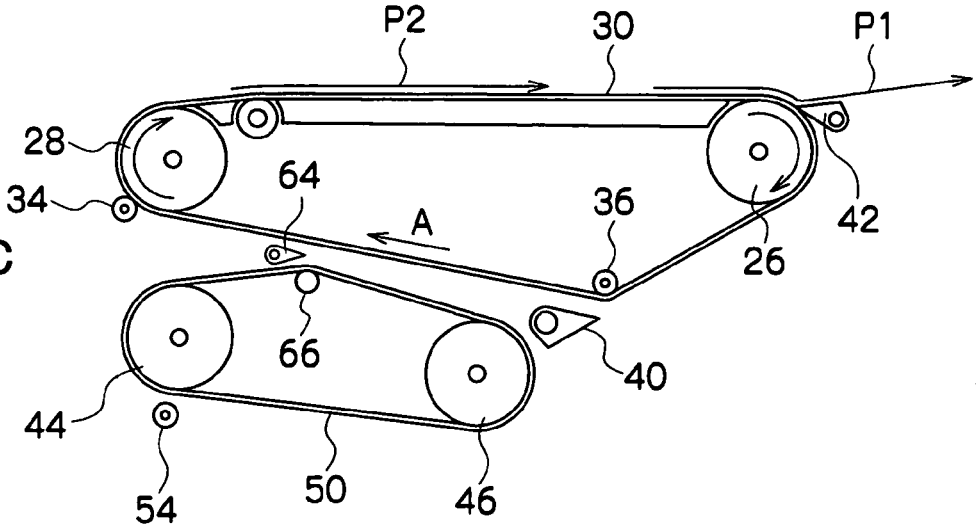

Hence, the two sheets of paper P1 and P2, whose rear faces have had images recorded thereon, are sequentially peeled from the conveyance belt 30 by the third separation pawl 42, as shown in FIG. 16C, and are conveyed by the conveyance roller pairs 56 to the ejection tray 18. Thus, single-pass two-sided printing of the plural consecutive sheets is completed.

Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30. Further, as shown in FIG. 16C, the second separation pawl 64 is separated from the inversion belt 50.

Next, multi-pass two-sided printing will be described. This printing mode differs from the single-pass two-sided printing described above only in that the paper P is fed to the recording position of the inkjet recording head 20 a number of times, and is accordingly not illustrated.

First, the first separation pawl 40 and the third separation pawl 42 are both moved away from the conveyance belt 30. Further, the pair of cleaning rollers 38 (the swinging roller 38B) is moved away from the conveyance belt 30 (see FIG. 5) and the charging roller 54 is driven with the inversion belt 50. Hence, in this state, paper P is supplied to the conveyance belt 30 by the pickup roller 24 and the conveyance roller pairs 56.

The paper P that has been fed onto the conveyance belt 30 and adheringly retained at the conveyance belt 30 is fed to the recording position of the inkjet recording head 20, and an image is recorded (printed) on one face (the front face) of the paper P. Then, the paper P is further conveyed, still being adheringly retained at the conveyance belt 30, and fed to the recording position of the inkjet recording head 20 a number of times. At this time, the charging roller 34 may be moved away from the conveyance belt 30 each time the paper P passes the charging roller 34.

On the occasion of a final printing on the front face, when the paper P has passed through a region of the first separation pawl 40, the first separation pawl 40 slidingly contacts the conveyance belt 30 before the final printing is completed. Accordingly, after the final printing on the front face, the paper P that has been adheringly retained and conveyed by the conveyance belt 30 is peeled from the conveyance belt 30 by the first separation pawl 40. The paper P that has been separated from the conveyance belt 30 is adheringly retained at the inversion belt 50, which is maintained at the same speed as the conveyance belt 30, and is conveyed in the direction of arrow F.

At this time, the charging roller 54 is moved away from the inversion belt 50 before the paper P is transferred from the conveyance belt 30 to the inversion belt 50. Then, at a time at which the paper P is completely adheringly retained onto the inversion belt 50, the inversion belt 50 turns in the direction of arrow R (switchbacks) at the same speed as the conveyance belt 30.

Then, contemporaneously with this reverse turning, the second separation pawl 64 is rotated downward (toward the inversion belt 50), and the portion of the inversion belt 50 at which the tension roller 66 is disposed is caused to slidingly contact the second separation pawl 64. As a result, the paper P is peeled off from the inversion belt 50 by the second separation pawl 64 (the second separation portion), at the location which is closer to the passive roller 28 than the location of the transfer from the conveyance belt 30 to the inversion belt 50, and is adheringly retained at the conveyance belt 30 again.

At this time, the front face side of the paper P, on which an image has been recorded (printed), is in surface contact with the conveyance belt 30 and is electrostatically adhered thereto. However, the speed of rotation of the driving roller 44 is regulated such that the speed of the inversion belt 50 does not change when the second separation pawl 64 rubs against the inversion belt 50, and the conveyance belt 30 and the inversion belt 50 are kept at equal speeds. Consequently, the image recorded (printed) on the front face does not rub against the conveyance belt 30. Therefore, a defect in image quality will not be caused.

Hence, the paper P that has been adheringly retained back onto the conveyance belt 30 is again fed to the recording position of the inkjet recording head 20 and an image is recorded (printed) on the other face (the rear face) thereof. Then, the paper P remains adheringly retained at the conveyance belt 30 and is further conveyed and fed to the recording position of the inkjet recording head 20 a number of times. Similarly to the time of printing on the front face, the charging roller 34 may be moved away from the conveyance belt 30 each time the paper P passes the charging roller 34.

On the occasion of a final printing on the rear face, when the paper P has passed through a region of the third separation pawl 42, the third separation pawl 42 slidingly contacts the conveyance belt 30 before the final printing is completed. Accordingly, after the final printing on the rear face, the paper P that has been adheringly retained and conveyed by the conveyance belt 30 is peeled from the conveyance belt 30 by the third separation pawl 42 and conveyed to the ejection tray 18 by the conveyance roller pairs 56.

Thus, multi-pass two-sided printing is completed. Here, when the third separation pawl 42 is rubbing against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30. Further, the second separation pawl 64 is separated from the inversion belt 50.

Figure 17A:
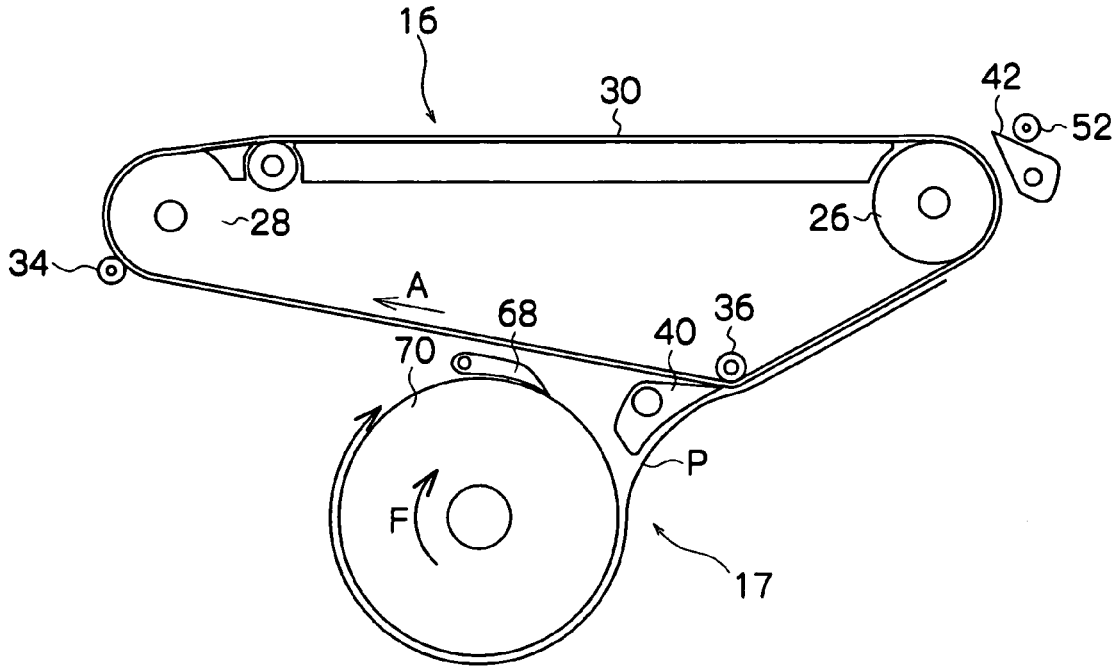
FIGS. 17A and 17B are schematic side views showing structure of a switchback section of a fourth embodiment, which is provided with an inversion drum.
Figure 17B:
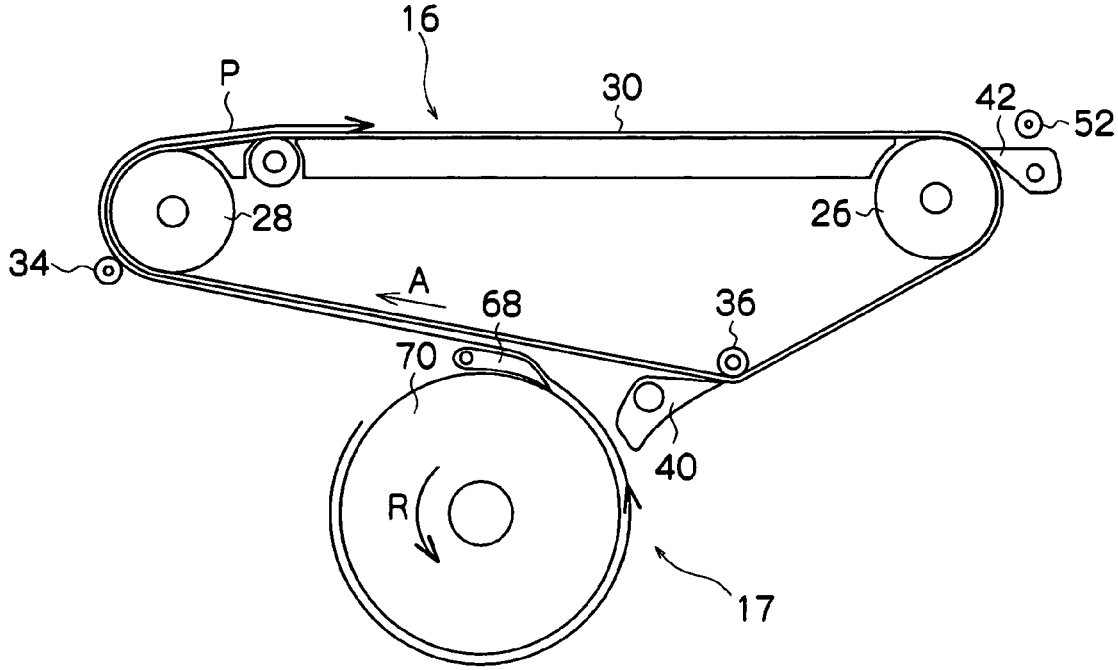

Lastly, a fourth embodiment will be described. As shown in FIGS. 17A and 17B, the fourth embodiment is formed with an inversion drum 70 instead of the inversion belt 50 wound round the driving roller 44, the passive roller 46 and the tension roller 48 (or 60 or 66). The inversion drum 70 is structured to be capable of rotary driving in the forward and reverse directions and is structured to be capable of electrostatically adhering the paper P. In this case, a second separation pawl 68 is required to serve as the second separation portion for peeling the paper P from the inversion drum 70.

Specifically, in the case of the inversion drum 70, it is not possible to provide a region at which a local radius of curvature is small, as with the inversion belt 50 described for the first embodiment and the second embodiment. Therefore, the paper P will not automatically peel off at a time of inversion (when the inversion drum 70 switchbacks). Therefore, it is necessary to provide the second separation pawl 68 at a position from which it is possible to feed the paper P back onto the conveyance belt 30 (a position which is closest to the conveyance belt 30), and to forcibly peel paper P that has been adheringly retained at the inversion drum 70 from the inversion drum 70 with this second separation pawl 68.

The second separation pawl 68 may be a structure which is constantly in sliding contact with the inversion drum 70, and may be a structure which is in sliding contact with the inversion drum 70 only at a time of peeling off the paper P. For the case of the inversion drum 70, in single-pass one-sided printing, single-pass two-sided printing in the case of intermittently feeding one sheet at a time, single pass two-sided printing in the case of consecutively feeding a number of sheets, and multi-pass two-sided printing, the inversion belt 50 of the third embodiment is simply substituted with this inversion drum 70. Therefore, for descriptions of these operations, only multi-pass two-sided printing will be described and the other printing modes will not be described.

In the case of multi-pass two-sided printing, first, the first separation pawl 40 and the third separation pawl 42 are both moved away from the conveyance belt 30 and the pair of cleaning rollers 38 (the swinging roller 38B) is moved away from the conveyance belt 30 (see FIG. 5). Hence, in this state, paper P is supplied to the conveyance belt 30 by the pickup roller 24 and the conveyance roller pairs 56.

The paper P that has been fed onto the conveyance belt 30 and adheringly retained at the conveyance belt 30 is fed to the recording position of the inkjet recording head 20, and an image is recorded (printed) on one face (the front face) of the paper P. Then, the paper P is further conveyed, still being adheringly retained at the conveyance belt 30, and fed to the recording position of the inkjet recording head 20 a number of times. At this time, the charging roller 34 may be moved away from the conveyance belt 30 each time the paper P passes the charging roller 34.

On the occasion of a final printing on the front face, when the paper P has passed through a region of the first separation pawl 40, the first separation pawl 40 slidingly contacts the conveyance belt 30 before the final printing is completed. Accordingly, after the final printing on the front face, the paper P that has been adheringly retained and conveyed by the conveyance belt 30 is peeled from the conveyance belt 30 by the first separation pawl 40. The paper P that has been peeled from the conveyance belt 30 is adheringly retained at the inversion drum 70, which is maintained at the same speed as the conveyance belt 30, and is conveyed in the direction of arrow F (see FIG. 17A).

Then, at a time at which the paper P is completely adheringly retained onto the inversion drum 70, the inversion drum 70 turns in the direction of arrow R (switchbacks) at the same speed as the conveyance belt 30. Thus, the paper P is peeled from the inversion drum 70 by the second separation pawl 68 sliding against the inversion drum 70, and is adheringly retained at the conveyance belt 30 again (see FIG. 17B).

At this time, the front face side of the paper P, on which an image has been recorded (printed), is in surface contact with the conveyance belt 30 and is electrostatically adhered thereto. However, because the inversion drum 70 is kept at the same speed as the conveyance belt 30, the image recorded (printed) on the front face does not rub against the conveyance belt 30. Therefore, a defect in image quality will not be caused.

Hence, the paper P that has been adheringly retained back onto the conveyance belt 30 is again fed to the recording position of the inkjet recording head 20 and an image is recorded (printed) on the other face (the rear face) thereof. Then, the paper P remains adheringly retained at the conveyance belt 30 and is further conveyed and fed to the recording position of the inkjet recording head 20 a number of times. Similarly to the time of printing on the front face, the charging roller 34 may be moved away from the conveyance belt 30 each time the paper P passes the charging roller 34.

On the occasion of a final printing on the rear face, when the paper P has passed through a region of the third separation pawl 42, the third separation pawl 42 slidingly contacts the conveyance belt 30 before the final printing is completed. Accordingly, after the final printing on the rear face, the paper P that has been adheringly retained and conveyed by the conveyance belt 30 is peeled from the conveyance belt 30 by the third separation pawl 42 and conveyed to the ejection tray 18 by the conveyance roller pairs 56.

Thus, multi-pass two-sided printing is completed. Here, when the third separation pawl 42 is sliding against the conveyance belt 30, the first separation pawl 40 is moved away from the conveyance belt 30 and, as shown in FIGS. 3 and 4, the pair of cleaning rollers 38 (the swinging roller 38B) is driven with the conveyance belt 30.

As has been described with the first to fourth embodiments hereabove, the inversion belt 50 (or inversion drum 70), for inverting paper P of which one face has been printed, adheringly retains the face of the paper P that has not been printed. Thus, a deterioration of image quality due to scraping of the printed face is avoided. In addition, an ink-drying duration can be assured by adheringly retaining the paper P at the inversion belt 50 (or inversion drum 70) for a time. (I.e., it is possible to provide an amount of time before the printed face is put into surface contact with the conveyance belt 30.)

Furthermore, because the inversion belt 50 (or inversion drum 70) is circulatingly driven (turned) at the same speed as the conveyance belt 30, when the paper P is supplied back to the conveyance belt 30 and the printed face is adheringly retained thereat (put into surface contact therewith), there will be no sliding between the paper P and the conveyance belt 30. Therefore, even at this time, a deterioration of image quality due to scraping of the printed face is avoided.

Further yet, because the inversion belt 50 (or inversion drum 70) is disposed directly below the conveyance belt 30 and the location of transfer of the paper P from the inversion belt 50 (or inversion drum 70) to the conveyance belt 30 is set to be closer to the passive roller 28 than the location of transfer of the paper P from the conveyance belt 30 to the inversion belt 50 (or inversion drum 70), there is no disadvantage of a path length of the paper P being made longer, and it is possible to re-supply the paper P from the inversion belt 50 (or inversion drum 70) to the conveyance belt 30 quickly. Therefore, a reduction in productivity at a time of two-sided printing can be avoided, and an improvement in two-sided printing efficiency can be achieved.

Further still, in a case of two-sided printing in which a number of sheets of paper P are consecutively fed together, it is possible to invert and re-supply a first sheet of paper P1 and a second sheet of paper P2 without reversing the order thereof, simply by employing a simple structure which reverses the direction of turning of the inversion belt 50 at a time at which the trailing end of the first sheet of paper P1 has passed the second separation portion but the leading end of the second sheet of paper P2 has not yet approached the second separation portion, or the like.

Thus, complicated processing at, for example, a computer for exchanging the order of printing data of the first sheet of paper P1 and printing data of the second sheet of paper P2, or the like, is not required, and it is possible to avoid the addition of such a burden to processing of the printing data. As a result, it is possible to avoid the occurrence of problems such as increasing costs due to increases in data processing durations and reductions in data processing capabilities.

Note that the conveyance belt 30 and inversion belt 50 (and inversion drum 70) which transport the paper P by circulatory driving (turning) in predetermined directions are not limited to structures which retain paper P by electrostatic attraction. Structures which retain paper P by non-electrostatic means, such as friction with the paper P, suction or adhesion of the paper P and the like, are also possible.

The locations of the driving roller 26 and the passive roller 28 may be exchanged and the locations of the driving roller 44 and the passive roller 46 may be exchanged. The driving roller 26 and the driving roller 44 are connected with a drive motor (not shown) by unillustrated gears (or directly). The drive motor is not particularly limited in regard to type.

Further, although not illustrated, this inkjet recording device 10 is equipped with a recording head control section and a system control section. In accordance with image signals, the recording head control section determines droplet ejection times and nozzles that are to be used, and applies driving signals to those nozzles. The system control section controls overall operations of the inkjet recording device 10.

The inkjet recording device relating to the present invention is not limited to devices to be employed in recording text and images on paper, such as facsimile machines, photocopiers, printers, multifunction devices, recording devices which are employed as output apparatuses for workstations and the like, and the like. For example, application is also possible to the ejection of colorant inks onto polymer films, glasses and the like for the fabrication of color filters for displays and the like.

That is, a "recording medium" of the present invention is not limited to paper P, and includes, for example, OHP sheets, substrates on which wiring patterns and the like are to be formed, and so forth. Further, an "image" of the present invention is not necessarily an ordinary image (text, a picture, a photograph or the like), and includes dot patterns (wiring patterns) which can be obtained by impacting ink droplets onto recording mediums and the like.

Furthermore, a fluid to be ejected is not specifically limited to ink. For example, it is possible to apply the inkjet recording device relating to the present invention to general droplet discharge apparatuses that are used in various industrial applications, such as, for example, ejecting molten solder onto substrates to form bumps for mounting components, ejecting organic electroluminescent solutions onto substrates to form EL display panels, and so forth.

Anyway, in a possible inkjet recording device of the present invention, a conveyance section includes a conveyance belt wound round at least two rollers, a switchback section includes an inversion belt wound round at least two rollers, and the inkjet recording device also includes: a first separation portion, which separates a recording medium from the conveyance belt for transferring the recording medium from the conveyance belt to the inversion belt; a second separation portion, which separates the recording medium from the inversion belt for transferring the recording medium from the inversion belt to the conveyance belt; and a third separation portion, which separates the recording medium from the conveyance belt for ejection.

In another possible inkjet recording device of the present invention, the conveyance section includes a conveyance belt wound round at least two rollers, the switchback section includes an inversion drum, and the inkjet recording device also includes: a first separation portion, which separates the recording medium from the conveyance belt for transferring the recording medium from the conveyance belt to the inversion drum; a second separation portion, which separates the recording medium from the inversion drum for transferring the recording medium from the inversion drum to the conveyance belt; and a third separation portion, which separates the recording medium from the conveyance belt for ejection.

According to the structures described above, because the first separation portion, the second separation portion and the third separation portion are provided, the recording medium can be promptly separated from the conveyance belt and the inversion belt or inversion drum. As a result, a loss of productivity at times of two-sided printing can be avoided.

In the inkjet recording device of the present invention, the inversion belt may turn at the same speed as the conveyance belt, with the inversion belt turning in a reverse direction, from a direction of turning when the recording medium is being transferred from the conveyance belt, for transferring the recording medium to the conveyance belt.

Alternatively, in the inkjet recording device of the present invention, the inversion drum may turn at the same speed as the conveyance belt, with the inversion drum turning in a reverse direction, from a direction of turning when the recording medium is being transferred from the conveyance belt, for transferring the recording medium to the conveyance belt.

According to the structures described above, because the conveyance belt and the inversion belt or inversion drum are turned at equal speeds, printed images will not be rubbed against the conveyance belt or against the inversion belt or inversion drum at times of handover of recording mediums. Consequently, image quality defects will not occur.

In the inkjet recording device of the present invention, the second separation portion may include a tension roller which alters curvature of the inversion belt.

According to the structure described above, the recording medium is separated from the inversion belt by a change in the location of the tension roller. Thus, structure of the second separation portion can be kept simple.

In the inkjet recording device of the present invention, the second separation portion may include a separation pawl.

According to the structure described above, because the recording medium is separated from the inversion belt or inversion drum by the separation pawl, separation can be performed reliably.

In the inkjet recording device of the present invention, a location at which the recording medium is transferred from the conveyance belt to the inversion belt may differ from a location at which the recording medium is transferred from the inversion belt to the conveyance belt.

In the inkjet recording device of the present invention, a location at which the recording medium is transferred from the conveyance belt to the inversion drum may differ from a location at which the recording medium is transferred from the inversion drum to the conveyance belt.

According to the structures described above, because the location at which the recording medium is handed over from the conveyance belt to the inversion belt or inversion drum differs from the location at which the recording medium is handed over from the inversion belt or inversion drum to the conveyance belt, there will not be a problem with a path length of the recording medium being made longer, and the recording medium can be promptly supplied back to the conveyance belt. As a result, a loss of productivity at times of two-sided printing can be avoided.

In the inkjet recording device of the present invention, at a time at which the recording medium is plurally adhered to the inversion belt, a direction of turning of the inversion belt may change to the reverse direction at a time after a trailing end of a first recording medium has passed the second separation portion but before a leading end of a second recording medium approaches the second separation portion.

According to the structure described above, a number of recording mediums can be quickly inverted without changing a sequence thereof. As a result, a loss of productivity at times of two-sided printing can be avoided.

The inkjet recording device of the present invention may include a recognition section capable of recognizing a position of the recording mediums on the inversion belt.

According to the structure described above, a period of inversion by the inversion belt can be reliably controlled. As a result, a loss of productivity at times of two-sided printing can be reliably avoided.

According to the present invention in any of the forms described above, an inkjet recording device can be provided which, in two-sided printing, is capable of avoiding a deterioration in image quality due to rubbing of a printed image and is capable of avoiding a reduction in productivity.

What is claimed is:

1. An inkjet recording device for forming an image on a recording medium with an inkjet recording head, the inkjet recording device comprising:

a conveyance section to which one face of the recording medium is adhered, the conveyance section conveying the recording medium to the inkjet recording head; and a switchback section to which the recording medium, on another face of which an image has been formed, is transferred from the conveyance section, the one face of the recording medium being adhered to the switchback section, and the switchback section re-supplying the recording medium to the conveyance section such that the other face of the recording medium can be adhered to the conveyance section;

wherein the conveyance section includes a conveyance belt wound round at least two rollers, the switchback section includes an inversion drum, and the inkjet recording device further includes:

a first separation portion, which separates the recording medium from the conveyance belt for transferring the recording medium from the conveyance belt to the inversion drum;

a second separation portion, which separates the recording medium from the inversion drum for transferring the recording medium from the inversion drum to the conveyance belt; and a third separation portion, which separates the recording medium from the conveyance belt for ejection.

2. The inkjet recording device of claim 1, wherein the inversion drum turns at the same speed as the conveyance belt, and the inversion drum turns in a reverse direction, from a direction of turning when the recording medium is being transferred from the conveyance belt, for transferring the recording medium to the conveyance belt.

3. The inkjet recording device of claim 1, wherein the second separation portion comprises a separation pawl.

4. The inkjet recording device of claim 1, wherein a location at which the recording medium is transferred from the conveyance belt to the inversion drum differs from a location at which the recording medium is transferred from the inversion drum to the conveyance belt.

5. An inkjet recording device for forming an image on a recording medium with an inkjet recording head, the inkjet recording device comprising:

a conveyance section to which one face of the recording medium is adhered, the conveyance section conveying the recording medium to the inkjet recording head, and including a conveyance belt wound round at least two rollers;

a switchback section to which the recording medium, on another face of which an image has been formed, is transferred from the conveyance section, the one face of the recording medium being adhered to the switchback section, the switchback section re-supplying the recording medium to the conveyance section such that the other face of the recording medium can be adhered to the conveyance section, and the switchback section including an inversion belt wound round at least two rollers;

a first separation portion, which separates the recording medium from the conveyance belt for transferring the recording medium from the conveyance belt to the inversion belt;

a second separation portion, which separates the recording medium from the inversion belt for transferring the recording medium from the inversion belt to the conveyance belt; and a third separation portion, which separates the recording medium from the conveyance belt for ejection.

6. The inkjet recording device of claim 5, wherein the inversion belt turns at the same speed as the conveyance belt, and the inversion belt turns in a reverse direction, from a direction of turning when the recording medium is being transferred from the conveyance belt, for transferring the recording medium to the conveyance belt.

7. The inkjet recording device of claim 6, wherein, at a time at which a plurality of recording mediums are adhered to the inversion belt, a direction of turning of the inversion belt changes to the reverse direction at a time after a trailing end of a first recording medium has passed the second separation portion but before a leading end of a second recording medium approaches the second separation portion.

8. The inkjet recording device of claim 7, further comprising a recognition section capable of recognizing a position of at least one of the plurality of recording mediums on the inversion belt.

9. The inkjet recording device of claim 5, wherein the second separation portion comprises a tension roller which alters curvature of the inversion belt.

10. The inkjet recording device of claim 9, wherein the tension roller comprises a movable structure.

11. The inkjet recording device of claim 5, wherein the second separation portion comprises a separation pawl.

12. The inkjet recording device of claim 11, wherein the switchback section comprises at least one tension roller, and the at least one tension roller is capable of causing the separation pawl to slidingly contact the inversion belt.

13. The inkjet recording device of claim 12, wherein, at a time at which the separation pawl is slidingly contacting the inversion belt, a speed of rotation of at least one of the at least two rollers of the switchback section is regulated for regulating speed of the inversion belt.

14. The inkjet recording device of claim 5, wherein a location at which the recording medium is transferred from the conveyance belt to the inversion belt differs from a location at which the recording medium is transferred from the inversion belt to the conveyance belt.

15. The inkjet recording device of claim 5, wherein the inkjet recording device further comprises a first charging roller which is driven with the conveyance belt, the first charging roller charges the conveyance belt, and the recording medium is electrostatically adhered to and conveyed by the charged conveyance belt.

16. The inkjet recording device of claim 5, wherein the inkjet recording device further comprises a second charging roller which is driven with the inversion belt, the second charging roller charges the inversion belt, the recording medium is electrostatically adhered to and conveyed by the charged inversion belt, and the second charging roller comprises a movable structure.

* * * * *